US012649544B2

(12) United States Patent
Barry et al.

(10) Patent No.: US 12,649,544 B2
(45) Date of Patent: Jun. 9, 2026

(54) DEEP LEARNING PREDICTIVE AUTOMATION AND CONTROL SYSTEM FOR AN AIR DISTRIBUTION SYSTEM

(71) Applicant: AIRGLIDE AI, INC, Fort Lauderdale, FL (US)

(72) Inventors: Iyaan Barry, Boca Raton, FL (US); David Bell, Naples, FL (US)

(73) Assignee: AIRGLIDE AI, INC, Fort Lauderdale, FL (US)

( * ) Notice: Subject to any disclaimer, the term of this patent is extended or adjusted under 35 U.S.C. 154(b) by 0 days.

(21) Appl. No.: 19/386,111

(22) Filed: Nov. 11, 2025

(65) Prior Publication Data

US 2026/0062096 A1 Mar. 5, 2026

Related U.S. Application Data

(63) Continuation-in-part of application No. 19/075,734, filed on Mar. 10, 2025, and a continuation-in-part of (Continued)

(51) Int. Cl.
*B63B 1/38* (2006.01)
*B63B 13/00* (2006.01)

(Continued)

(52) U.S. Cl.
CPC ..... *B63B 1/38* (2013.01); *B63B 13/00* (2013.01); *B63B 79/10* (2020.01); *B63B 79/30* (2020.01);

(Continued)

(58) Field of Classification Search
None
See application file for complete search history.

(56) References Cited

U.S. PATENT DOCUMENTS

2011/0259257 A1* 10/2011 Costas ..... B63B 1/38 114/289
2024/0208611 A1* 6/2024 Armson ..... B63B 1/38

(Continued)

FOREIGN PATENT DOCUMENTS

KR 20230041516 A * 3/2023 ..... B63B 1/38
KR 20260024955 A * 2/2026 ..... B63H 21/38

OTHER PUBLICATIONS

Machine Translation: Kim KR-20230041516-A (Year: 2023).*
Machine Translation: Woo KR-20260024955-A (Year: 2026).*

*Primary Examiner* — Ryan Rink
(74) *Attorney, Agent, or Firm* — Origins Law, LLC; Nicholas Spatola

(57) ABSTRACT

A computer-implemented control system and method for dynamically managing airflow in an air lubrication system of a vessel are disclosed. Real-time sensor data including vessel motion, acceleration, and speed-through-water are processed by a controller executing a machine learning model to predict near-future sea-state conditions. The controller accesses and interpolates computational fluid dynamics (CFD) efficiency profiles to determine target airflow values and generate valve and compressor commands that modulate airflow to multiple outlets beneath the hull. Feedback from hull and pressure sensors is used to stabilize the air layer, while a learning-based prediction engine continuously refines CFD profiles to improve operational efficiency and reduce parasitic load. The system enhances vessel hydrodynamic performance and fuel economy under varying environmental conditions.

27 Claims, 14 Drawing Sheets

Related U.S. Application Data application No. 18/948,969, filed on Nov. 15, 2024, which is a continuation-in-part of application No. 18/219,375, filed on Jul. 7, 2023, now Pat. No. 12,263,914, which is a continuation-in-part of application No. 18/119,324, filed on Mar. 9, 2023, now Pat. No. 12,097,932.

(60) Provisional application No. 63/733,841, filed on Dec. 13, 2024, provisional application No. 63/454,549, filed on Mar. 24, 2023, provisional application No. 63/439,306, filed on Jan. 17, 2023, provisional application No. 63/427,144, filed on Nov. 22, 2022.

(51) Int. Cl.
*B63B 79/10* (2020.01)
*B63B 79/30* (2020.01)
*B63B 79/40* (2020.01)

(52) U.S. Cl.
CPC ..... *B63B 79/40* (2020.01); *B63B 2013/005* (2013.01)

(56) References Cited

U.S. PATENT DOCUMENTS

2025/0050975 A1* 2/2025 Karmous ..... B63B 1/38
2026/0015064 A1* 1/2026 Karmous ..... B63B 1/38

* cited by examiner

DEEP LEARNING PREDICTIVE AUTOMATION AND CONTROL SYSTEM FOR AN AIR DISTRIBUTION SYSTEM

CROSS-REFERENCE TO RELATED APPLICATIONS

This application is a continuation-in-part of co-pending U.S. patent application Ser. No. 18/948,969, entitled "System and Method for Enhanced Marine Vessel Efficiency Using Integrated Hull Optimizations", filed Nov. 15, 2024. U.S. patent application Ser. No. 18/948,969 is a continuation-in-part of U.S. patent application Ser. No. 18/219,375, now granted U.S. Pat. No. 12,263,914, entitled "A System and Method for Delivering Air to a Submerged Ship Surface", filed Jul. 7, 2023. U.S. patent application Ser. No. 18/219,375 is a continuation-in-part of U.S. patent application Ser. No. 18/119,324, entitled "A System and Method for Reducing Drag on Hulls of Marine Crafts Thereby Increasing Fluid Dynamic Efficiencies", filed Mar. 9, 2023, now U.S. Pat. No. 12,097,932, which claims the benefit of priority pursuant to 35 U.S.C. § 119 (e) to U.S. Provisional Patent Application Ser. No. 63/439,306, filed Jan. 17, 2023, and U.S. Provisional Patent Application Ser. No. 63/427,144, filed Nov. 22, 2022. U.S. patent application Ser. No. 18/219,375 also claims priority pursuant to 35 U.S.C. § 119 (e) to U.S. Provisional Application Ser. No. 63/454,549, entitled "A System and Method for Delivering Air to a Submerged Ship Surface", filed Mar. 24, 2023. All of which are hereby incorporated by reference in their entireties for all purposes. This application is also continuation-in-part of co-pending U.S. patent application Ser. No. 19/075,734, entitled "Aerodynamically Enhanced Air Lubrication Nozzle and Flap", filed Mar. 10, 2025. This application also claims the benefit of priority pursuant to 35 U.S.C. § 119 (e) to U.S. Provisional Patent Application Ser. No. 63/733,841, entitled "Airflow Throttling Based on Ship Motion Dynamic for an Air Lubrication System", filed Dec. 13, 2024. All of which are hereby incorporated by reference in their entireties for all purposes.

FIELD OF THE INVENTION

The present invention relates generally to marine automation systems, and more particularly to computer-implemented control systems for managing air lubrication operational processes.

BACKGROUND

Modern maritime transport faces increasing pressure to comply with international emission reduction mandates, such as those set forth by the International Maritime Organization (IMO), which require progressive decreases in greenhouse gas (GHG) emissions from ocean-going vessels. As fuel costs and regulatory compliance continue to drive operational expenses, ship owners and naval architects are motivated to explore technologies that enhance hydrodynamic efficiency and reduce energy consumption. The correlation between fuel consumption and $CO_2$ output means that improving propulsion efficiency directly contributes to both environmental and economic goals.

Various strategies have emerged to address these challenges. Some involve exhaust aftertreatment solutions such as scrubbers, which remove sulfur oxides ($SO_x$) and particulate matter from the exhaust gases to meet emissions standards. While such systems effectively mitigate airborne pollutants, they do not address the underlying issue of energy loss through hydrodynamic drag. Other innovations, such as rotor sails utilizing the Magnus effect to generate auxiliary propulsion, or hybrid and nuclear propulsion systems aiming to eliminate or supplement fossil fuel burn, seek to improve energy utilization at the propulsion stage. However, these technologies typically operate independently of hull-fluid interactions and therefore provide limited benefit to overall vessel hydrodynamic efficiency.

A significant portion of a ship's fuel consumption is expended in overcoming hull resistance, particularly viscous drag at the hull-water interface. For this reason, advances in hull design and surface treatments have been critical to improving efficiency. Developments such as optimized hull geometries, antifouling coatings, and enhanced propulsion components have each contributed incremental gains. Yet, as vessel designs approach hydrodynamic optimization limits, further substantial efficiency improvements require new approaches that manipulate the flow dynamics surrounding the hull itself.

Air lubrication systems represent one such approach. By introducing a layer of air bubbles between the hull and the surrounding water, these systems reduce the effective wetted surface area and frictional resistance, thereby lowering fuel consumption. However, legacy methods simply flood the area with air bubbles, many of which are wasted because they are too far away from the hull of the surface, and thus, the energy savings are often completely offset by the energy required to run the system. This leads to ship engineers turning the systems off because the use of these systems leads to more maintenance required without an efficiency benefit.

To produce a viable air lubrication system, the system must be able to account for various sources of drag and environmental variability. U.S. patent application Ser. No. 18/119,324, entitled "A System and Method for Reducing Drag on Hulls of Marine Crafts Thereby Increasing Fluid Dynamic Efficiencies," discloses a superaerophilic bottom hull surface configured to maintain an air plastron by encouraging air adhesion. That disclosure also introduces an air distribution network from compressors to the hull surface. U.S. patent application Ser. No. 18/219,375 ("the '375 application"), entitled "A System and Method for Delivering Air to a Submerged Ship Surface," introduces a nozzle system to take air from the distribution network and discharge it strategically below the hull of a ship, which is more readily deployable than a porous surface layer. Unlike legacy air lubrication systems that rely on shear forces from downward-facing nozzles, the '375 application introduces a descendible flap that directs hydrodynamic flow below the air plastron, allowing greater air coverage and improved efficiency. Nonetheless, these systems still experience efficiency losses in unsteady or varying sea states.

Despite their promise, all air lubrication systems are often limited by inefficiencies in air distribution and management, particularly in dynamic sea conditions. While current air lubrication systems can be turned on and off by the user, it is not efficient in varying sea states. In such situations, air will dissipate towards the side it can rise fastest, leading to large swaths of areas of the ship hull which are then subjected to drag once again. Without adaptive control, much of the injected air fails to adhere to the hull where it provides the greatest benefit, leading to energy inefficiencies that can offset or even exceed the potential drag reduction. The efficiency loss is particularly noticeable in long-distance voyages where vessels operate at higher speeds and for prolonged periods. At these speeds, even a small increase in drag can lead to substantial fuel wastage.

Furthermore, even when systems employ user or software-based activation, delays associated with valve operation and air pressurization can prevent timely responses to rapidly changing sea conditions. The transient nature of rough or variable seas, where wave heights, directions, and periods fluctuate over seconds, renders constant or throttled air delivery ineffective. Accordingly, there exists a need for an intelligent air lubrication system capable of monitoring sea states through real-time feedback and dynamically adjusting air output and flap or cover positions. Such a system would maintain optimal air distribution and ensure continuous efficiency gains under true operational conditions.

SUMMARY OF THE INVENTION

The invention disclosed herein provides a computer-implemented method for dynamically controlling airflow in an air lubrication system of a vessel. The computer-implemented method for dynamically controlling airflow in an air lubrication system of a vessel comprises the steps of (i) receiving, by a controller, real-time sensor data from one or more vessel instruments including at least a gyroscope, an accelerometer, and a speed-through-water sensor, (ii) determining, by the controller, a motion state of the vessel based on the sensor data, the motion state comprising roll, pitch, yaw, surge, sway, and heave parameters, (iii) predicting, using a machine learning model executed by the controller, a near-future vessel motion condition based on the motion state, historical voyage data, and environmental data including ocean current and wind vectors, (iv) accessing, by the controller, a computational fluid dynamics (CFD) data set and CFD efficiency profile correlating vessel motion conditions and environmental data with optimal airflow distributions beneath a hull of the vessel, (v) interpolating, by the controller, between entries in the CFD data set to compute one or more target airflow values corresponding to the predicted near-future vessel motion condition, (vi) generating, by the controller, valve control commands and compressor drive signals based on the target airflow values, (vii) transmitting the valve control commands and compressor drive signals to an air distribution subsystem comprising one or more controllable valves and at least one compressor, and (viii) modulating, by the air distribution subsystem, airflow delivered to a plurality of nozzles or air outlets positioned beneath the hull of the vessel in accordance with the valve control commands and compressor drive signals, thereby maintaining an efficient and substantially uniform air layer under varying sea-state conditions.

The invention disclosed herein also provides a system for dynamically controlling airflow in an air lubrication system of a vessel. The system for dynamically controlling airflow in an air lubrication system of a vessel includes at least one compressor, a plurality of controllable valves, a sensor network comprising one or more sensors, a control unit comprising a processor and a memory. The at least one compressor is configured to deliver pressurized air to an air distribution network. The plurality of controllable valves is fluidly coupled to the at least one compressor and configured to regulate airflow to a plurality of air outlets positioned beneath a hull of the vessel. The sensor network comprising one or more sensors includes gyroscopes, accelerometers, and speed-through-water sensors, configured to provide real-time vessel motion and speed data. The memory is used for storing executable instructions and a computational fluid dynamics (CFD) data set correlating vessel motion and environmental parameters with optimal airflow distributions.

The processor is configured to execute the executable instructions to (i) determine a motion state of the vessel based on the real-time vessel motion and speed data, (ii) predict, using a machine learning model, a near-future vessel motion condition based on the motion state, historical voyage data, and environmental conditions, (iii) interpolate one or more target airflow values from the CFD data set corresponding to the predicted near-future vessel motion condition, (iv) generate valve control commands and compressor drive signals based on the interpolated target airflow values, and (v) transmit the valve control commands and compressor drive signals to the plurality of controllable valves and the at least one compressor to modulate airflow delivered to the plurality of air outlets. The control unit adjusts the airflow to maintain a substantially uniform air layer beneath the hull under varying sea-state conditions.

The invention disclosed herein yet further provides an electronic device for air lubrication system control is disclosed. The electronic device comprises at least one processor and a memory with instructions stored thereon. The instructions, once executed, perform the steps of (i) receiving, by a controller, real-time sensor data from one or more vessel instruments including at least a gyroscope, an accelerometer, and a speed-through-water sensor, (ii) determining, by the controller, a motion state of the vessel based on the sensor data, the motion state comprising roll, pitch, yaw, surge, sway, and heave parameters, (iii) predicting, using a machine learning model executed by the controller, a near-future vessel motion condition based on the motion state, historical voyage data, and environmental data including ocean current and wind vectors, (iv) accessing, by the controller, a computational fluid dynamics (CFD) data set and CFD efficiency profile correlating vessel motion conditions and environmental data with optimal airflow distributions beneath a hull of the vessel, (v) interpolating, by the controller, between entries in the CFD data set to compute one or more target airflow values corresponding to the predicted near-future vessel motion condition, (vi) generating, by the controller, valve control commands and compressor drive signals based on the target airflow values, (vii) transmitting the valve control commands and compressor drive signals to an air distribution subsystem comprising one or more controllable valves and at least one compressor, and (viii) modulating, by the air distribution subsystem, airflow delivered to a plurality of nozzles or air outlets positioned beneath the hull of the vessel in accordance with the valve control commands and compressor drive signals, thereby maintaining an efficient and substantially uniform air layer under varying sea-state conditions.

It is an object of the present invention to provide a computer-implemented control method and system that dynamically regulates airflow distribution in an air lubrication system based on real-time vessel motion and environmental data, thereby maintaining an efficient and substantially uniform air layer beneath the hull under varying sea-state conditions.

It is yet another object of the present invention is to incorporate a machine learning or reinforcement learning model that predicts near-future vessel motion conditions and preemptively adjusts air injection parameters, reducing parasitic load and enhancing overall system efficiency.

It is a further object to integrate computational fluid dynamics (CFD) efficiency profiles with real-time sensor inputs within a unified control architecture, enabling the controller to interpolate target airflow values, generate optimized valve and compressor commands, and continuously refine operational efficiency through adaptive feedback.

The drawings and specific descriptions of the drawings, as well as any specific or alternative embodiments discussed, are intended to be read in conjunction with the entirety of this disclosure. The invention may be embodied in many different forms and should not be construed as being limited to the embodiments set forth herein; rather, these embodiments are provided by way of illustration only and so that this disclosure will be thorough, complete and fully convey understanding to those skilled in the art. The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
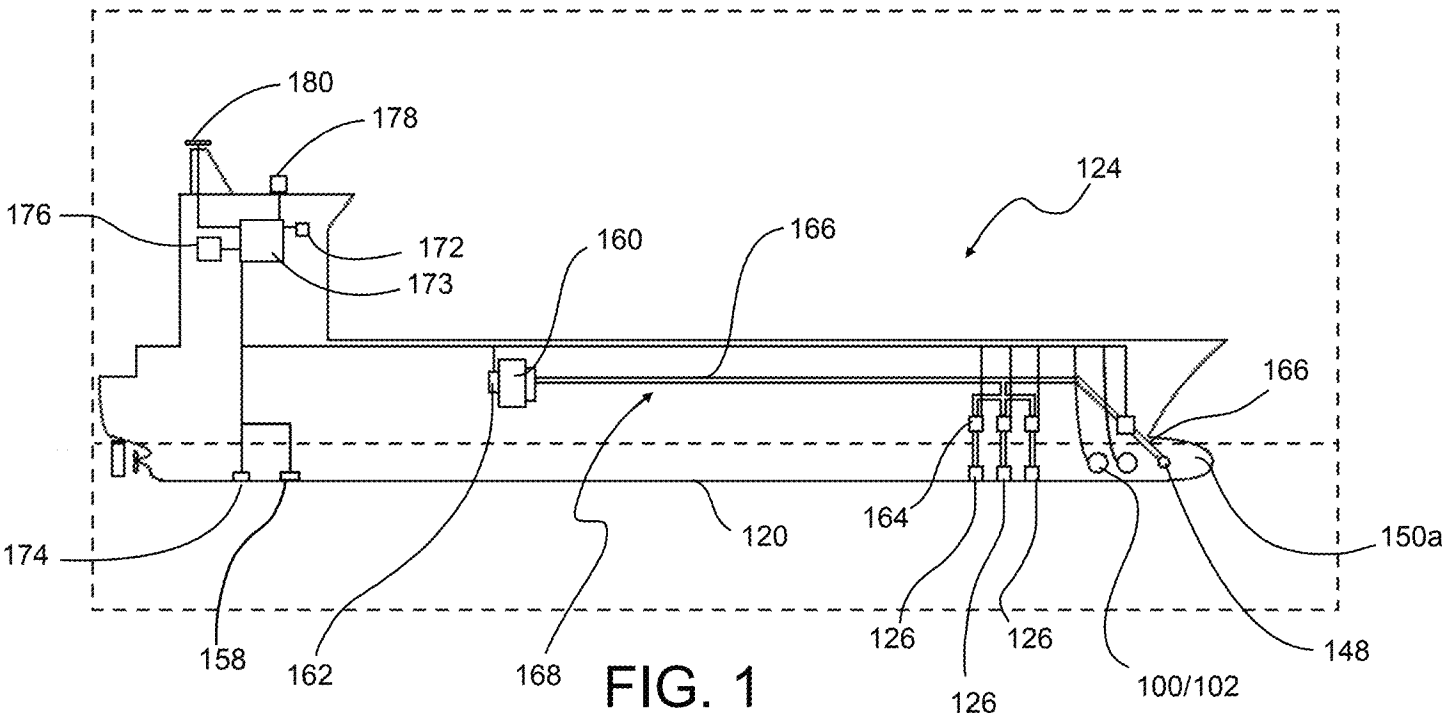
FIG. 1 illustrates a schematic side view of a vessel incorporating an air lubrication system in accordance with one embodiment of the present invention.

The invention herein provides a solution for the inefficiencies and operational instabilities present in existing ship air lubrication systems (ALS) under varying sea conditions. The invention includes a uniquely configured automated airflow control system capable of dynamically modulating air distribution beneath a ship's hull in response to real-time and near-real-time predictive vessel motion and environmental dynamics. Through intelligent throttling and control of airflow, the disclosed system maintains an optimal air layer for drag reduction, fuel efficiency, and propulsion stability even in turbulent or high-motion conditions.

Current air lubrication systems, while effective under calm or predictable operating conditions, often fail to maintain consistent efficiency in dynamic marine environments. Existing systems generally rely on static compressor outputs or fixed flow rates that do not account for rapid changes in ship motion or sea state. When the vessel encounters rough seas, waves, or varying load conditions, these conventional systems either overcompensate by delivering excess air, creating turbulence and wasted energy, or underperform, leading to loss of the air layer and diminished drag reduction.

While some conventional marine stabilization systems employ deployable fin stabilizers, these stabilizers are designed to correct vessel motion but do not regulate or influence the behavior of the hydrodynamic flow caused by rough sea state conditions, and therefore, do not prepare current air lubrication systems to adjust the air layer beneath the hull. The introduction of air between the hull and surrounding water to reduce skin-friction drag is inherently sensitive to flow pressure, velocity, and orientation. In unsteady seas, these parameters fluctuate continuously, causing conventional air lubrication systems to operate inefficiently and unpredictably. Even where stabilization devices are active, they only affect the vessel's motion, not the stability or uniformity of the air layer itself.

When subjected to rolling, pitching, and yawing motions, the air layer becomes unevenly distributed, leading to localized losses of lubrication and increased hydrodynamic drag. Excessive air injection, often used to counteract these effects, further destabilizes flow beneath the hull, generating turbulence that negates much of the intended efficiency gain.

Moreover, traditional ALS control architectures lack intelligent feedback mechanisms. They do not continuously interpret sensor data or environmental inputs to adjust airflow. In practice, system operators must rely on manual tuning or preconfigured flow profiles, which are ineffective in changing weather and sea conditions. This limitation often forces operators to disable the ALS entirely in rough seas, eliminating its benefits during periods when drag reduction could provide the greatest fuel savings.

The industry thus faces a persistent challenge: maintaining effective air lubrication under real-world maritime conditions characterized by variable speed, heading, and wave motion. In such environments, efficiency losses compound rapidly, reducing both economic and environmental performance. A need therefore exists for a system that can autonomously sense, predict, and respond to changing hydrodynamic forces, regulating airflow distribution in a manner that preserves the air layer and minimizes power consumption.

The disclosed invention directly addresses these challenges by introducing an adaptive airflow throttling system integrated with real-time motion sensing and predictive control logic. The system utilizes continuous feedback from onboard gyroscopes, accelerometers, and flow sensors to characterize the vessel's six degrees of freedom (roll, pitch, yaw, surge, sway, and heave) and adjust air delivery accordingly. Through this configuration, the invention enables consistent performance across varying sea states without requiring operator intervention.

The system also integrates a learning-based prediction engine that models vessel dynamics using historical data and computational fluid dynamics simulations. This allows the control logic to anticipate upcoming motion conditions, such as wave impact or hull orientation, and adjust airflow proactively, maintaining a stable and efficient air cushion beneath the vessel.

Computational fluid dynamics (CFD) refers to the numerical modeling and simulation of fluid flow phenomena through the solution of governing equations describing mass, momentum, and energy conservation. In CFD analysis, a fluid domain, such as the water volume surrounding a vessel hull, is discretized into a mesh or grid of finite elements. The Navier-Stokes equations are solved iteratively across this mesh to compute parameters including pressure, velocity, turbulence, and shear stress at discrete spatial and temporal points. These numerical solutions provide a high-fidelity approximation of how the fluid interacts with a given geometry or boundary condition.

In the context of the present system, CFD analysis is employed as a software-based modeling tool to characterize the hydrodynamic behavior of a marine vessel under a variety of operating and environmental conditions. Each simulation scenario may vary parameters such as vessel speed, hull attitude, sea-state profile, and airflow distribution beneath the hull. The resulting data are compiled into datasets representing CFD efficiency profiles that quantify the relationship between airflow rate, pressure distribution, and overall hydrodynamic drag. These profiles serve as reference models for the system's learning-based prediction engine. The profiles are stored on-vessel, in a system-attached server. The profiles may be loaded into interactive tables to provide indexed variables, easy for the system to lookup Because CFD analysis is computationally intensive, the underlying simulations are typically performed using specialized software modules or remote computing resources prior to vessel deployment. The output data are stored in memory as multidimensional tables, functions, or machine-learning-ready datasets accessible to the control logic during operation. By integrating CFD-derived data directly into the automation architecture, the system enables real-time decision making that is informed by physically accurate, pre-computed models rather than static empirical approximations. This integration transforms CFD results from a design-phase tool into a live operational dataset that continually informs and adapts vessel control strategies.

The learning-based prediction engine further collects and compiles operational datapoints during calm sea states. From these datapoints, the system can establish one or more efficiency profiles, each representing a learned relationship between vessel speed, airflow rate, hull orientation, and hydrodynamic resistance as determined through CFD modeling. The system can select or adapt among these efficiency profiles to reduce the air injection level required to sustain the air layer, thereby lowering parasitic load and improving overall net system efficiency.

The invention therefore overcomes the limitations of the background art by introducing a responsive, data-driven control methodology that dynamically harmonizes airflow delivery with ship motion and environmental input. This capability enables continuous operation in rough seas, reduces unnecessary compressor load, minimizes turbulence, and preserves the drag-reducing properties of the air lubrication layer.

This disclosure outlines the methodology and mathematical formulation for dynamically adjusting airflow in response to the six degrees of freedom (DOF) motion dynamics of a ship: roll, pitch, yaw, surge, sway, and heave. Proper airflow management is crucial for effective and efficient air lubrication system performance in rough seas. The following sections describe how the system dynamically responds to multi-axis vessel motion using data-driven airflow modulation informed by CFD efficiency profiles To dynamically adjust airflow in response to the six degrees of freedom (DOF) motion dynamics of a ship: roll, pitch, yaw, surge, sway, and heave, it is essential to understand how these motions influence air lubrication systems. In an air layer drag reduction (ALDR) air lubrication system, a layer of air is introduced between the ship's hull and the water to reduce frictional drag. The effectiveness of this layer depends on how well the air can be retained along the hull, even when the ship moves through turbulent water or encounters significant motions due to waves and environmental forces.

In rough sea conditions, the ship's movement across all six DOF (roll, pitch, yaw, surge, sway, and heave) introduces dynamic changes in the water flow around the hull. These motions can disrupt the air layer and reduce the effectiveness of the air lubrication system, as air bubbles are swept away by water forces or displaced due to changes in orientation.

By dynamically adjusting the airflow based on real-time ship motion and speed through water, the system can compensate for the changing conditions, ensuring a more stable and consistent air layer across the hull. Each degree of freedom affects how air interacts with the hull.

A rolling motion tilts the ship from side to side, causing air on one side to disperse more quickly than on the other. Adjusting the airflow on each side of the hull based on the roll angle ensures that both the port and starboard sides maintain a uniform air layer, minimizing air loss to maximize system efficiency.

Pitching occurs when the bow or stern moves up or down due to wave impacts. This motion changes the angle of attack of the water on the hull, making it harder for air bubbles to remain trapped against the surface. By throttling airflow based on the vessel's pitch, the system ensures a balanced air distribution along the hull. This adjustment helps maintain air retention and minimize drag by responding to varying conditions without specifically increasing or decreasing airflow in certain areas.

Yaw describes the horizontal twisting of the ship around its vertical axis. Similar to roll, yaw creates asymmetries in airflow needs on either side of the hull. The system must adjust airflow differentially to counteract yaw-induced imbalance and ensure equal drag reduction across both sides of the ship.

The ship's speed through water plays a critical role in determining how well the air layer is maintained along the hull. By monitoring the speed through water and accounting for external currents, the system can evaluate how water flows on both the port and starboard sides. The relative motion of the ship, combined with the effects of water currents, influences how air is distributed and retained. If one side of the ship is impacted more by currents, the system adjusts the airflow dynamically to compensate, ensuring that air remains effectively distributed across the hull. This approach ensures optimal air retention and drag reduction, while at lower speeds, the system uses less airflow to conserve energy.

Regarding improved efficiency and air retention, by precisely managing the airflow based on the ship's orientation and speed through water, the air lubrication system maintains a more stable and consistent air layer. This consistent layer leads to reduced frictional drag and optimized energy usage. The system can reduced frictional drag by keeping more air between the hull and water, the system minimizes the friction that the ship encounters, reducing fuel consumption and emissions. The system optimizes energy use by dynamically adjusting to prevent the system from overcompensating with airflow when it's not necessary, preserving energy.

Figure 2:
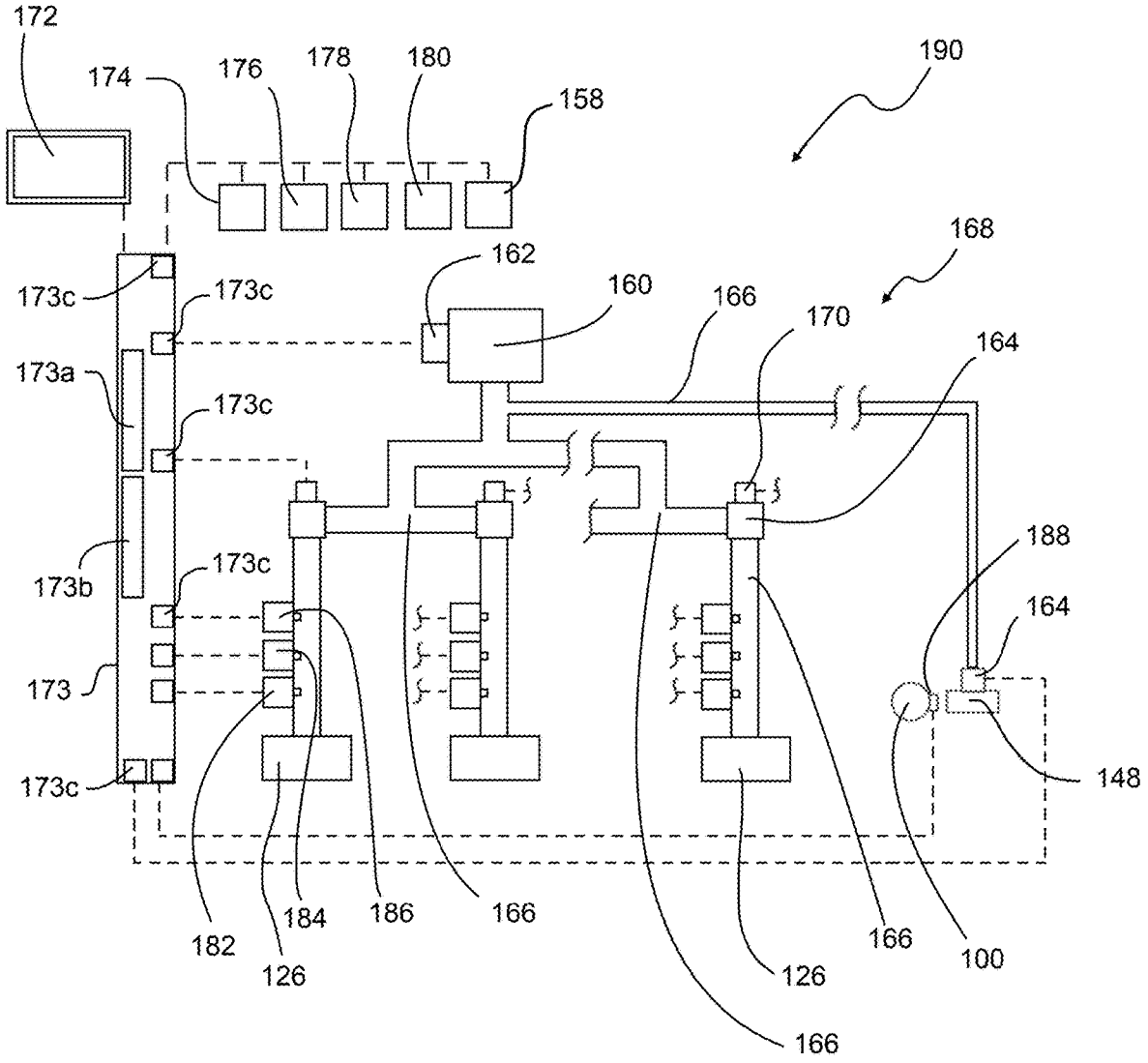
FIG. 2 illustrates a sectional schematic view of the system.

FIGS. 1 and 2 show simplified diagrams of the system. The system takes real-time gyro, accelerometer, and speed through water sensor data as input, processes it to determine the ship's full motion dynamics and environmental conditions, and then uses this information to adjust the airflow on both the port and starboard sides.

The objective is to create a robust model that throttles airflow based on the ship's six degrees of freedom motion: roll, pitch, yaw, surge, sway, and heave, along with the speed through water and environmental conditions. The airflow system will adjust dynamically based on the real-time orientation and motion characteristics of the ship, including differential control for the port and starboard sides.

The reinforcement learning-based motion forecasting model is also critical to understanding the conditions that need to be compensated for. To accurately predict and adjust airflow based on the ship's six degrees of freedom (DOF) motion dynamics, a reinforcement learning (RL) model is used. This model forecasts the ship's future motion based on real-time sensor data, historical patterns, and environmental conditions such as current and wind, enabling the system to dynamically adjust airflow in the air lubrication system for optimal performance.

Accurate input sensor data is also key to the operation of the system. The RL model relies on real-time data from the ship's gyroscopes, accelerometers, and speed through water sensors to capture angular velocities, linear accelerations, and the ship's speed, which are essential for understanding the various motions of the ship.

Several sensors are used at acquiring the data points. The gyroscopes measure the angular velocities around the roll, pitch, and yaw axes. Accelerometers measure linear accelerations along surge, sway, and heave axes. Speed through water sensors provide data on the magnitude and direction of the ship's movement through the water.

Additionally, environmental data can be obtained and integrated using Global Positioning System (GPS). GPS data is used for redundant validation of the speed through water and its directional vector measured by the onboard sensors, retrieving wind and current speed, as well as their directional vectors, from the internet, and obtaining bathymetry data to account for underwater terrain and its effects on ship motion.

The raw sensor data can often contain noise that distorts the true motion dynamics of the ship. A noise filtering algorithm, such as a low-pass filter, is applied to clean the data, providing more accurate signals that reflect the ship's actual motion.

The reinforcement learning (RL) model allows the system to predict and adapt to the ship's motion dynamics in real time. The RL model is trained on past motion and environmental data and learns how to predict the future motion of the ship by analyzing previous sensor data, including angular velocities, accelerations, speed through water, current, and wind data. It continuously adapts as it receives new data, improving its accuracy over time, especially as conditions at sea change.

Using the current sensor data and what the model has learned, the RL system predicts the future states of the ship for each degree of freedom. These predictions allow the system to adjust airflow in real-time, optimizing the efficiency of the air lubrication system based on the ship's predicted motion and environmental factors.

Airflow is dynamically adjusted through a multi-dimensional CFD efficiency profiles that correlates the ship's six degrees of freedom (DOF), speed through water, current, and wind with real-time motion and environmental data. The efficiency profiles contains detailed information on the time period and maximum amplitude for each DOF, derived from precomputed CFD simulations under various conditions. The optimal airflow values for both the port and starboard sides are computed using CFD simulations. The algorithm selects the closest matching conditions from the efficiency profiles to determine the appropriate airflow adjustments.

The CFD efficiency profile database been generated from extensive simulations that model the ship's behavior in different sea states, accounting for the combined influence of roll, pitch, yaw, surge, sway, heave, speed through water, and environmental factors such as current and wind. The efficiency profiles database contains time period data, maximum amplitude data, speed through water and environmental data, and optimal airflow values. Time periods for each degree of freedom (DOF) represent the cycle duration of the ship's motion (e.g., roll period, pitch period). The maximum amplitude reflects the peak motion angle or acceleration for each DOF. The efficiency profiles database includes the influence of speed through water and the direction and magnitude of currents and winds on the ship's motion. The optimal airflow values for both the port and starboard sides are computed directly from CFD simulations, ensuring that the airflow is finely tuned to the ship's dynamic behavior. This information is stored for a wide range of motion scenarios, providing a comprehensive database that the airflow control system can reference during real-time operation.

Also provided is an algorithm for matching conditions. The real-time airflow adjustment process follows the steps of: acquiring sensor data, mixing and matching closest conditions, interpolating values, calculating airflow, and adjusting for linear motion.

Regarding sensor data acquisition, real-time sensor data from gyroscopes (for angular velocities), accelerometers (for linear accelerations), speed through water sensors (for speed magnitude and direction), and GPS is used to capture the ship's current 6DOF motion state and environmental conditions.

When mixing and matching the closest conditions, the algorithm compares the real-time sensor inputs (angular velocities, accelerations, speed-through-water, current, and wind) with the stored data in the efficiency profiles database. For each DOF and environmental condition, the system selects the closest matching time period and maximum amplitude from the efficiency profiles database. This process allows different DOF conditions (roll, pitch, yaw, etc.) and environmental factors to be independently matched to their respective closest simulations.

When interpolating values, if an exact match isn't found, the algorithm uses interpolation between multiple entries in the efficiency profiles database to compute the appropriate airflow response. This ensures smooth transitions and fine-tuned airflow adjustments, even for intermediate or previously unobserved motion states.

For airflow calculations, the selected or interpolated data from the efficiency profiles is used to compute the optimal airflow adjustment for both the port and starboard sides. By combining the closest matched values for roll, pitch, yaw, surge, sway, heave, speed through water, and environmental conditions, the system dynamically modulates the airflow to optimize air lubrication based on the ship's current motion and external forces. The CFD-generated airflow values ensure that the airflow adjustment is precise and optimized for the given motion and environmental conditions When adjusting for linear motions, the surge, sway, and heave components, along with speed through water, are accounted for by selecting the closest corresponding entries in the efficiency profiles database, ensuring that linear motions and environmental factors influence the airflow control in a balanced manner.

There are several advantages of using the CFD efficiency profiles. It provides a comprehensive control over the system. The system can handle a wide variety of motion and environmental conditions by mixing and matching the closest entries in the efficiency profiles database for each degree of freedom and environmental factor. This ensures accurate airflow control across complex and dynamic sea conditions. It also provides real-time efficiency. Using a precomputed CFD efficiency profile allows for fast lookup and interpolation of airflow values, enabling real-time control without the need for recalculating complex CFD equations.

The CFD efficiency profiles database also provides for higher accuracy. The efficiency profiles database's detailed information on time periods, maximum amplitudes, speed through water, and environmental factors, combined with CFD-computed airflow values, ensures precise adjustments that closely mirror the ship's real-time motion and environmental forces, enhancing the performance of the air lubrication system The CFD efficiency profiles database provides smooth transitions. By interpolating between matched conditions, the system avoids abrupt changes in airflow, ensuring a smooth adjustment as the ship's motion evolves over time.

Real-time feedback from hull sensors enhances air flow. Real-time feedback from hull sensors is used to monitor air coverage. These sensors measure air distribution and thickness along the hull, enabling precise airflow adjustments when necessary. The system continuously analyzes sensor data to detect air coverage deficiencies. When gaps or thinning are detected, the system dynamically adjusts airflow to maintain optimal coverage. This ensures that disruptions caused by ship motions, waves, or environmental factors are quickly corrected.

For optimization and learning, the system not only reacts to real-time data but also learns from it over time. By correlating specific ship motions (such as roll, pitch, or yaw) with changes in air coverage, the system can proactively anticipate where and when to adjust airflow before significant disruptions occur. This continuous optimization ensures that the system becomes more efficient over time, minimizing unnecessary airflow adjustments and conserving energy while maintaining a consistent air layer.

For integration with the CFD efficiency profiles, the real-time feedback system works in tandem with the multidimensional CFD efficiency profiles. While the efficiency profiles provide precomputed airflow values based on predicted motion dynamics, the feedback from hull sensors allows the system to fine-tune these values during operation. This dual approach, combining predictive modeling with realtime feedback, ensures optimal performance under all conditions.

While the preceding describes a generalized airflow throttling control architecture applicable to multiple vessel motion parameters, the following disclosure provides a more specific example implementation focusing on roll dynamics. This disclosure demonstrates how the principles described above can be expressed mathematically and implemented through real-time control algorithms. It should be understood that the equations and relationships disclosed herein represent one example of the predictive and corrective methodologies that may be used within the broader framework of the present invention.

For inputting gyro data, to accurately determine the roll dynamics of the ship, input data from the ship's gyroscope is utilized. The gyro data provides real-time measurements of the ship's angular velocity and orientation, which are critical for calculating the roll period and maximum roll angles.

Regarding gyroscope data acquisition, the gyroscope measures the angular velocity ($\omega$) around the roll axis Regarding noise filtering, the raw gyro data often contains noise, which can obscure the true roll dynamics of the ship. A filtering algorithm (such as a low-pass filter) is applied to the gyro data to smooth out the noise. This results in a cleaner signal that better represents the ship's actual roll motion.

To reconstruct the sine function, once the noise is filtered, a sine function is reconstructed from the processed gyro data to model the ship's roll behavior:

$$\theta(t) = A \cdot \sin\left(2\pi \cdot \frac{t}{RollPeriod} + \phi\right)$$

where A is the amplitude (maximum roll angle), and $\phi$ is the phase shift determined by the initial conditions of the roll.

To calculate roll period and maximum angle, the roll period RollPeriod can be determined from the filtered gyro data. Assuming harmonic oscillation, the roll period can be calculated as follows:

$$RollPeriod = \frac{2\pi}{\omega}$$

where $\omega$ is w is the average angular velocity measured by the gyroscope during the filtered data. The maximum roll angles (RollAngleMax) for both the port and starboard sides can be derived from the amplitude A of the reconstructed sine function, which represents the peak roll angles.

Figure 13:
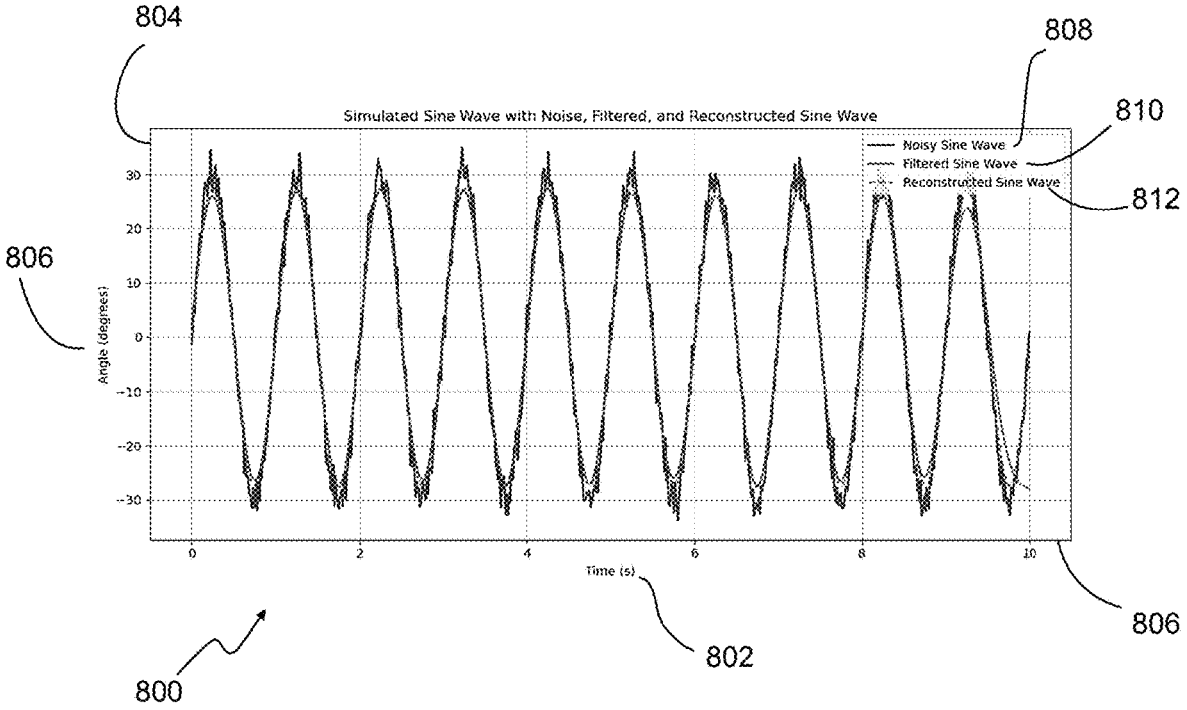
FIG. 13 illustrates the reconstructed roll angle curve $\theta(t)$ based on the filtered gyro data.

Regarding the reconstructed curve for roll angle, FIG. 13 illustrates the reconstructed roll angle curve $\theta(t)$ based on the filtered gyro data, where the x-axis represents time and the y-axis represents the roll angle in degrees. The sine curve clearly shows the oscillatory behavior of the ship's roll dynamics over time.

Airflow variables include MinAirFlow and MaxAirFlow. MinAirFlow is the minimum airflow value when the ship is at peak roll (either side). MaxAirFlow is the maximum airflow value when the ship is in a neutral position.

Time variables include Time and RollPeriod. Time is the current time, and RollPeriod is the time taken for one complete roll cycle, calculated from gyro data.

The roll angle as a function of time is represented as:

$$\theta(t) = 2\pi \cdot \frac{t}{RollPeriod}$$

For the transition function for smooth adjustment of roll dynamics, when the maximum roll angle or roll period changes due to varying sea conditions or ship movement, a transition function is introduced to ensure a smooth adjustment of the airflow throttling system. This function provides a gradual change in airflow values based on the updated roll parameters. The transition function T(t) accounts for changes in the maximum roll angle A and the roll period RollPeriod. It ensures that changes in the airflow throttling are not abrupt, allowing for a smooth adjustment over time.

For airflow calculations, there are two separate functions defined for throttling airflow based on the port and starboard sides: the port side airflow throttling function and the starboard side airflow throttling function.

Regarding the port side airflow throttling function, the airflow $A_{port}(t)$ for the port side is defined as:

$$A_{port}(t) = \begin{cases} MaxAirFlow & \text{if } t < 0 \\ MinAirFlow + (MaxAirFlow - MinAirFlow) \cdot (1 - \max(0, \sin(\theta(t)))) & \text{if } t \geq 0 \end{cases}$$

Regarding the starboard side airflow throttling function, the airflow $A_{starbd}(t)$ for the starboard side is defined as:

$$A_{starbd}(t) = \begin{cases} MaxAirFlow & \text{if } t < 0 \\ MinAirFlow + (\text{Max}AirFlow - MinAirFlow) \cdot (1 - \max(0, \sin(\theta(t)))) & \text{if } t \geq 0 \end{cases}$$

Both functions begin by checking whether the current time t is less than zero. If this condition is true, the airflow is set to its maximum value. For both the port and starboard functions, when t is zero or greater, the airflow is calculated based on the sine of the roll angle, which oscillates between −1 and 1. When the port side is rolled up (positive sine), the airflow is throttled toward MinAirFlow, and when the starboard side is rolled up (negative sine), the airflow is similarly throttled. In this way, the equations ensure that airflow adapts smoothly between MinAirFlow and MaxAirFlow, depending on the roll angle of the ship.

This represents a comprehensive approach to managing airflow based on the roll dynamics of a ship. The proposed functions effectively differentiate between the port and starboard sides, allowing for dynamic throttling of airflow based on the orientation of the vessel. By incorporating gyro data and reconstructing a sine function from filtered input, we can accurately determine the roll period and maximum angles, enhancing the precision of the airflow control system. Additionally, the transition function ensures smooth adjustments between different roll states, preventing abrupt changes in airflow The system continuously collects and compiles operational datapoints across all sea-state conditions. Prior to deployment, computational fluid dynamics (CFD) simulations may be used to generate a plurality of modeled scenarios representing different hull orientations, vessel speeds, and sea states. From these simulations, the system establishes an initial set of CFD efficiency profiles, each defining a learned relationship between vessel speed, airflow rate, hull attitude, and hydrodynamic resistance.

During operation, the control logic compares real-time sensor data to the existing CFD efficiency profiles and identifies the profile corresponding to the current sea-state condition. The system then applies the selected profile to determine optimal air injection parameters for maintaining the air layer. As the vessel continues to operate, newly collected datapoints are incorporated into the learning-based prediction engine, allowing it to refine the existing CFD efficiency profiles or generate additional profiles representing updated efficiency conditions. Over time, the system thereby enhances its own performance by adaptively modifying the optimized CFD application pathways for various sea states and vessel configurations.

In contrast to conventional automation systems that merely apply a nearest-variable match from a fixed lookup table, the disclosed deep-learning-based architecture is configured to understand the relationships underlying each efficiency profile and to modify those relationships as new data becomes available. This enables predictive and adaptive control that continually improves overall energy efficiency and drag reduction.

The learning-based prediction engine is configured to analyze the temporal sequence of CFD efficiency profiles encountered during vessel operation. By monitoring the rate of change in sensor-derived parameters and correlating them with the stored CFD efficiency profiles, the system can predict which efficiency profile is likely to occur next. This forward-looking capability enables the control logic to adjust airflow preemptively, initiating air delivery to the appropriate nozzles in advance of the anticipated sea-state condition.

In certain implementations, the system may apply the predicted CFD efficiency profile several seconds to several minutes before the corresponding sea-state condition is physically reached. By doing so, the system ensures that the injected air arrives at the hull surface coincident with the onset of the hydrodynamic conditions requiring it, thereby maintaining a continuous and stable air layer and further improving drag reduction efficiency.

Through this anticipatory mechanism, the system not only reacts to real-time sensor inputs but also proactively prepares for expected hydrodynamic changes, achieving a higher level of stability and efficiency than reactive or steady-state control architectures.

In certain embodiments, the system further comprises a transition modeling subsystem that learns and predicts transitions among the plurality of CFD efficiency profiles. The transition modeling subsystem may employ a machine learning or deep learning architecture, such as a recurrent neural network (RNN), long short-term memory (LSTM) network, or other sequence-prediction model, to analyze historical sequences of applied CFD efficiency profiles in combination with corresponding environmental and operational parameters. Through this analysis, the subsystem learns probabilistic relationships between sea-state evolution patterns and profile transitions, thereby generating a transition prediction model.

During operation, the transition prediction model forecasts one or more likely upcoming CFD efficiency profiles based on current and recent system states. The control logic may then preemptively adjust air injection commands or airflow routing according to the forecasted transition, ensuring that airflow modulation anticipates the hydrodynamic changes rather than responding after they occur. Over time, the transition prediction model continues to refine itself using new operational datapoints, improving the accuracy of profile-sequence prediction and further enhancing the overall efficiency and stability of air layer maintenance.

The disclosure, included herein, includes electronic and computer-related embodiments. As used herein, unless expressly stated otherwise, the singular forms "a," "an," and "the" include plural references, and the term "or" is intended to include "and/or." The terms "comprising," "including," and "having" are intended to be open-ended and mean "including but not limited to." The term "based on" is intended to mean "based at least in part on."

As used herein, the term "computing system" or "computer system" refers to any device or combination of devices capable of executing program instructions. This may include, without limitation, desktop computers, servers, embedded controllers, industrial automation modules, marine control units, or distributed cloud-based computing platforms.

The term "processor" or "CPU" refers to any data-processing unit capable of executing instructions, including one or more central processing units (CPUs), digital signal processors (DSPs), microcontrollers (MCUs), graphics processing units (GPUs), or other types of computing or control circuitry.

The term "memory" or "computer-readable medium" includes any form of non-transitory storage capable of storing data or instructions for access by a processor. Examples include random-access memory (RAM), read-only memory (ROM), flash memory, hard disk drives, solid-state drives, optical media, magnetic media, or any other suitable storage device. The term "non-transitory" excludes only transitory propagating signals per se, but includes all other forms of storage.

The term "module" or "engine" refers to a combination of hardware, firmware, or software components configured to perform one or more specific functions. A module may be implemented as a standalone unit or distributed across multiple computing devices or processors.

The term "program," "software," or "set of instructions" refers to a sequence of operations that, when executed by a processor, cause a computing system to perform one or more functions described herein. Software may be stored in memory and executed locally or remotely (e.g., via a networked computing environment).

The term "execution" or "executing" includes direct execution by a processor, interpretation by a virtual machine, or execution via just-in-time compilation.

As used herein, the term "communication interface" includes any hardware or software component that facilitates data exchange between computing devices or between a computing device and external sensors or actuators. Examples include wired or wireless interfaces, buses, fieldbus controllers, Ethernet, Wi-Fi, cellular, or satellite communication systems.

The term "sensor" refers to any device configured to measure or detect a physical, chemical, or environmental condition and generate corresponding data. The term "actuator" refers to any device that converts a control signal into physical action, such as a valve, pump, motor, air injector, or similar device.

In some embodiments, one or more modules may employ machine learning models or artificial intelligence algorithms. As used herein, "machine learning model" refers to any computational model that is trained using data to generate outputs or predictions based on input features, including but not limited to neural networks, decision trees, regression models, reinforcement learning agents, or other adaptive algorithms. Such models may be pre-trained or updated during operation.

The deep learning predictive automation and control system for an air distribution system of the present invention may be used to dynamically regulate airflow across an air lubrication system based on real-time vessel motion and environmental data; to anticipate and adjust airflow requirements through machine learning-based prediction of near-future hydrodynamic conditions; and to integrate computational fluid dynamics (CFD) efficiency profiles within an adaptive control framework that continuously optimizes valve and compressor operation for improved energy efficiency and hull performance. The system and related methods are particularly shown in FIGS. 1-15.

FIG. 1 illustrates a cross-sectional schematic side view of the active system 190 as implemented in a marine vessel 124. The system includes an automated air distribution system 168 comprising compressors 160 with distributed automation-control modules 162 connected via air conduits 166 to air lubrication nozzles 126. The control architecture includes sea state sensors such as Doppler 174, gyro 176, radar 180, and GPS units 178, all connected to a central user interface 172 and control module 173. In some embodiments, the system includes bow thruster covers 100/102, though these covers are not essential to the operability of the compressors, 160, air conduits 166, air lubrication nozzles 126 (sometimes referred to as air distribution nozzles or air outlets), or the associated automation-control modules 162. In some embodiments, the vessel may include a hull 120 with a bulbous bow 150*a* and strategically positioned air jets 148.

FIG. 2 illustrates a schematic diagram view of the control system architecture 190. The central automation-control module 173 includes a processor 173*a*, memory 173*b*, and input/output connections 173*c* interfacing with multiple system components. These components may include sea state sensors (Doppler 174, gyro 176, GPS 178, radar 180), air monitoring sensors (temperature 182, speed 184, pressure 186), compressor control modules 162, valve control modules 170, actuator control modules 188, and the user interface module 172. The automated air distribution system 168 coordinates air flow through compressors 160, valves 164, and conduits 166 to nozzles 126 and bow thruster covers 100.

Figure 3:
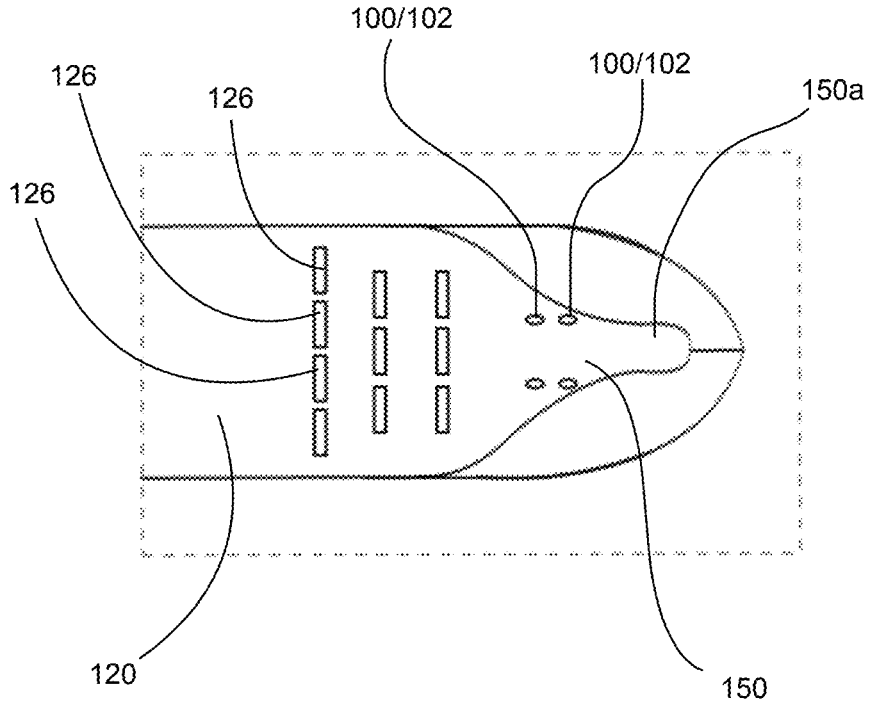
FIG. 3 illustrates a partial bottom view of the bow of a hull of the marine vessel showing a nozzle layout.

FIG. 3 illustrates a partial bottom view of the bow 150 and bulbous bow 150*a* section of the marine vessel hull 120, showing the strategic layout of air lubrication nozzles 126 and bow thruster covers 100/102 to optimize hydrodynamic efficiency.

Figure 4A:
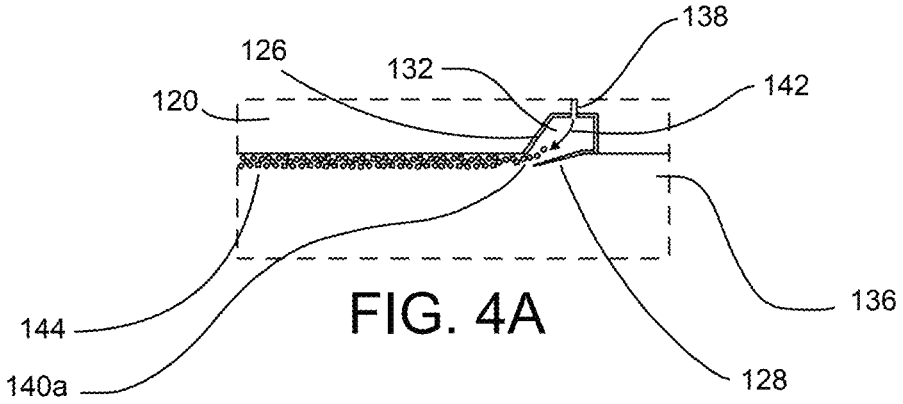
FIG. 4A illustrates a side view of a nozzle of the system disbursing air under the hull of the ship.

FIG. 4A illustrates a side view of an air lubrication nozzle 126 disbursing air under the hull 120 of the ship in a submerged environment 136. The nozzle assembly includes an open cavity 132, gas flow inlet 138, and a flow modulating nozzle flap 128. The gaseous flow 142 creates an air-interface boundary 140*a*, establishing an engaged air layer 144 along the hull surface.

Figure 4B:
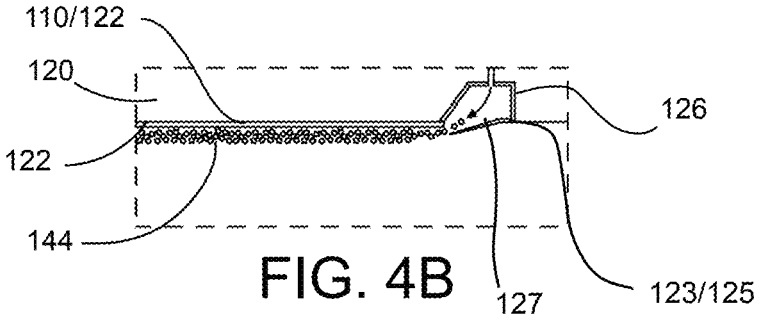
FIG. 4B illustrates a side view of a nozzle of the system disbursing air under the hull of the ship having a superaerophilic coating.

FIG. 4B illustrates a side view of an air lubrication nozzle 126 disbursing air under the hull 120 with a superaerophilic inducing surface 110/122. The hydrodynamically optimized surface 122 maintains an engaged air layer 144 more effectively than standard hull surfaces.

Figure 5:
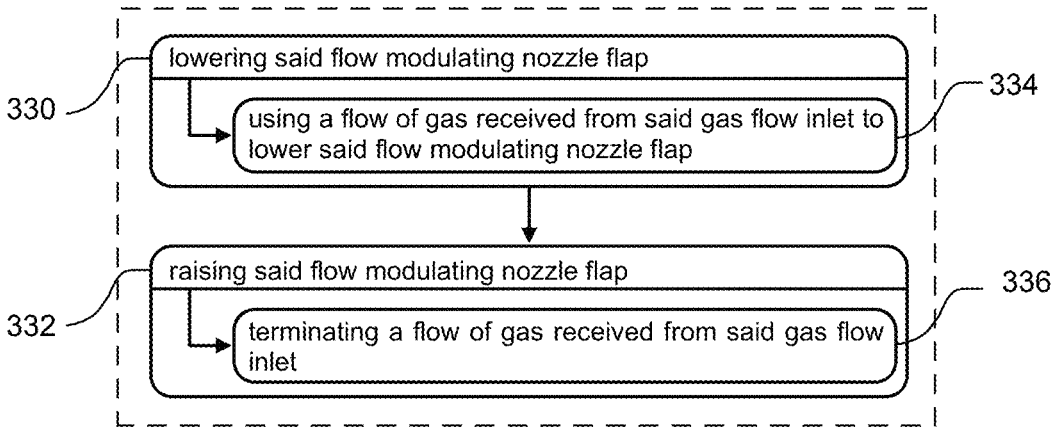
FIG. 5 illustrates a flow chart for a method of lowering and raising a nozzle flap.

FIG. 5 illustrates a flow chart for a method of lowering 330 and raising 332 a nozzle flap, including steps for gas flow control 334 and flow termination 336.

Figure 6:
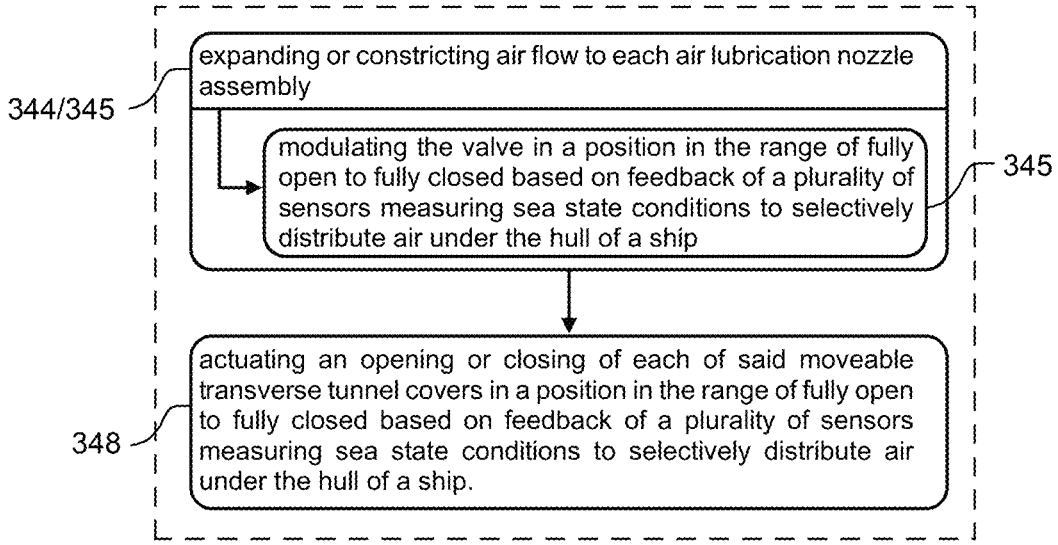
FIG. 6 illustrates a flow chart for a method of expanding or constricting airflow to the air lubrication nozzles to actuate the opening or closing of each nozzle.

FIG. 6 illustrates a flow chart for a method of expanding or constricting airflow 344/345 to the air lubrication nozzles and actuating cover positions 348 based on modulation parameters 345.

Figure 7:
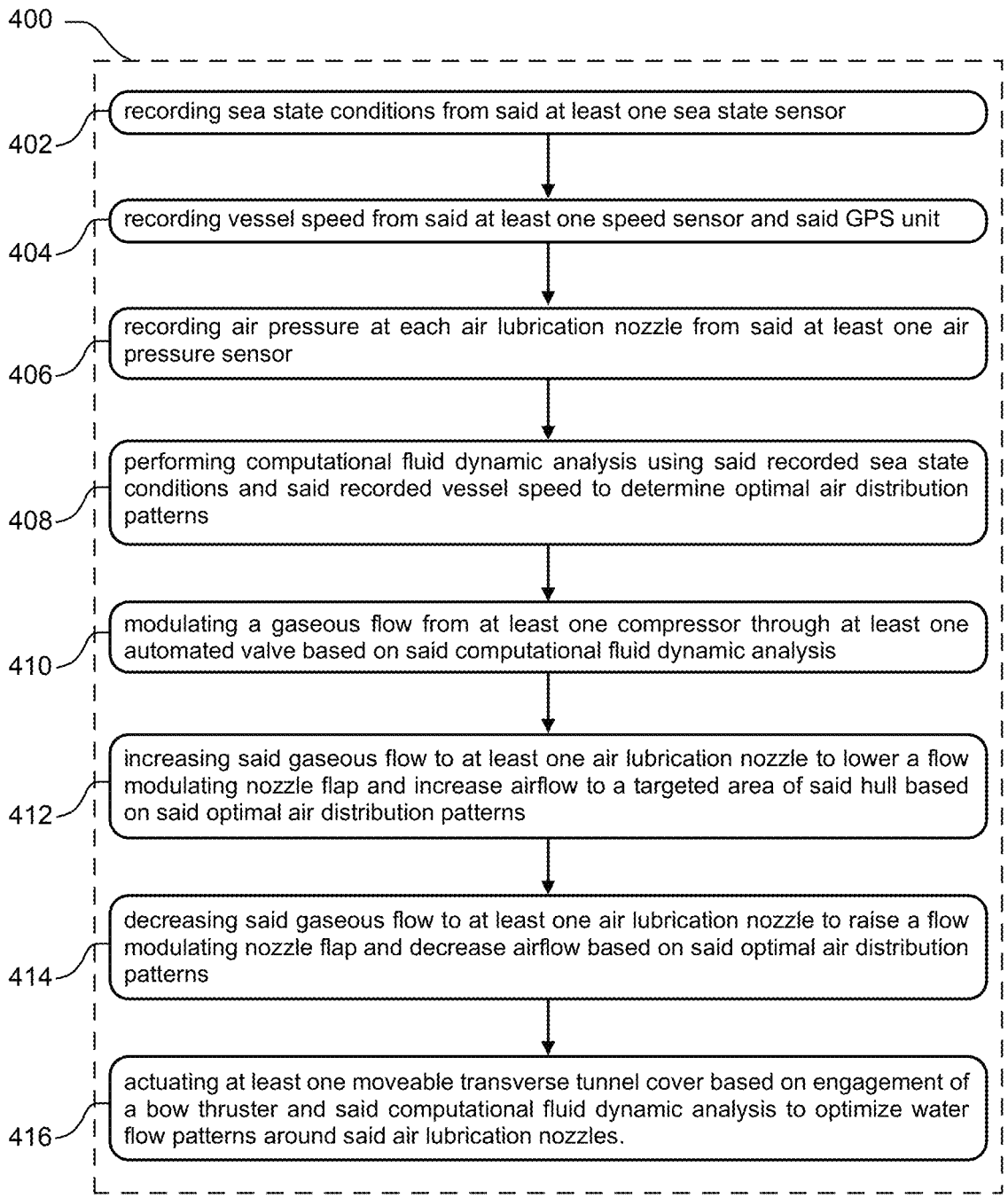
FIG. 7 illustrates a flow chart for method steps of a program for an automated control module of an active system for reducing hydrodynamic drag on a hull of a marine craft.

FIG. 7 illustrates a flow chart for method steps of a program 400 for an automated control module, including recording sea state conditions 402, vessel speed 404, and air pressure 406, performing computational analysis 408, modulating gas flow 410, increasing 412 and decreasing 414 airflow, and actuating covers 416.

Figure 8:
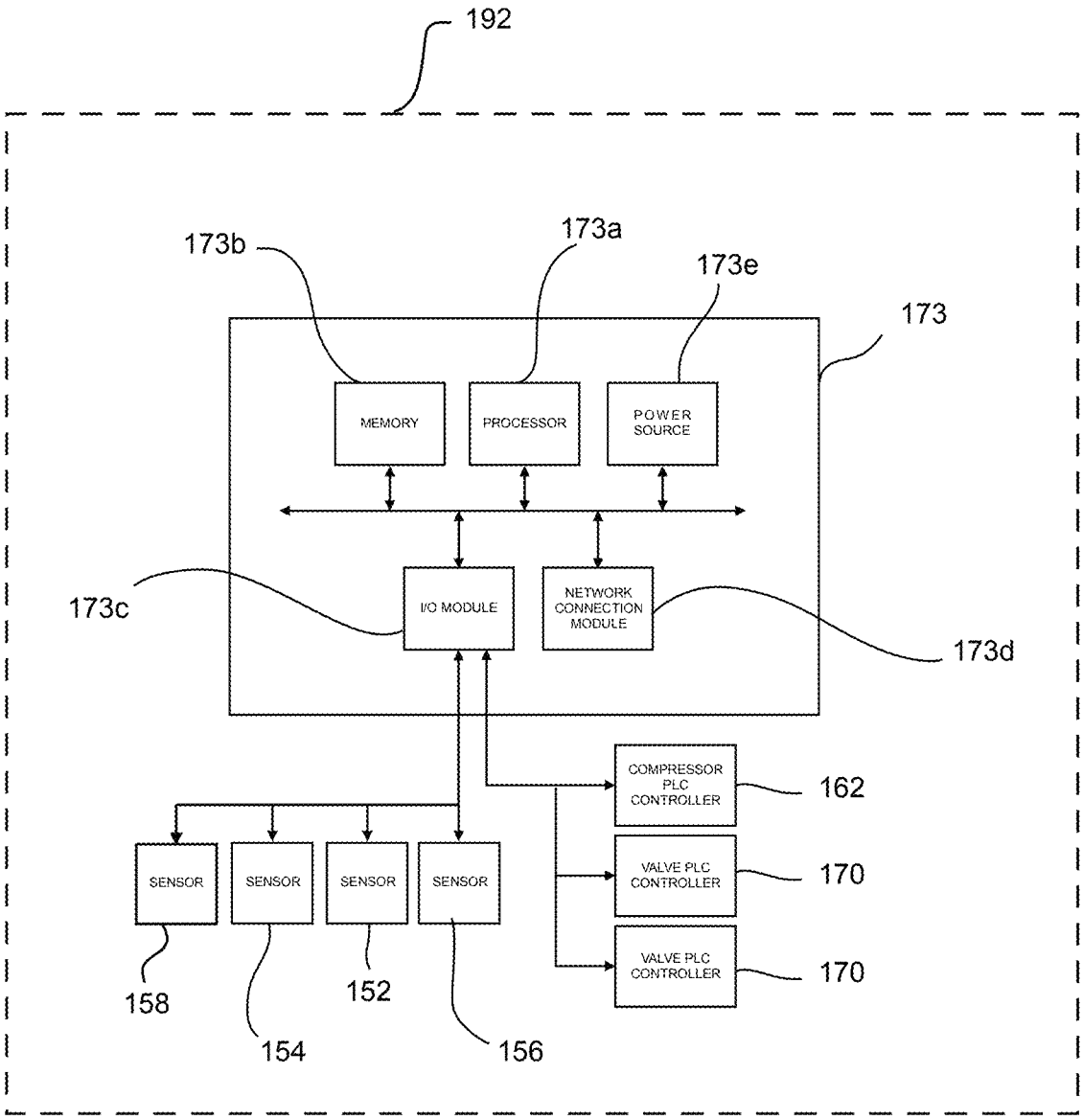
FIG. 8 illustrates a block diagram of the on-board server/controller.

FIG. 8 illustrates a block diagram of the on-board server/controller 173. The controller 173 includes the memory 173*b* containing the instructions, as well as the processor 173*a* for executing those functions. It should be appreciated that, although it is shown as one block in the figure, the memory 173*b* can be comprised of multiple types of hardware, and a plurality of devices. The same can be said with processor 173*a*. For example, modern computers use a combination of CPUs and GPUs for executing different tasks to achieve higher efficiency, and multiple cores are common place. The power source 173*e* is also shown. The network connection module 173*d* can be used to program the controller 173. Thus, the network connection 173*d* may be wireless or wired. The network connection 173*d* may, in some embodiments, be used for remote monitoring, as well as 2-way communication, providing a conduit to share data and enhance both the system on the ship and provide data to be used in calculations off the ship. The input/output (I/O) 173*c* module is used to connect the controller 173 to the various subsystems, including the PLC subsystem comprising compressor PLC controller(s) 162, and valve PLC controllers 170. The I/O 173*c* is also used to connect the plurality of sensors (accelerometer 154, gyro 152, and speed through water sensor 156), as shown in the figure. It is also used to connect to numerous other sensors, as may be seen or appreciated from FIG. 2, such as sea state sensors: Doppler 174, GPS 178, and radar 180, and air monitoring sensors: temperature 182, speed 184, pressure 186.

Figure 9:
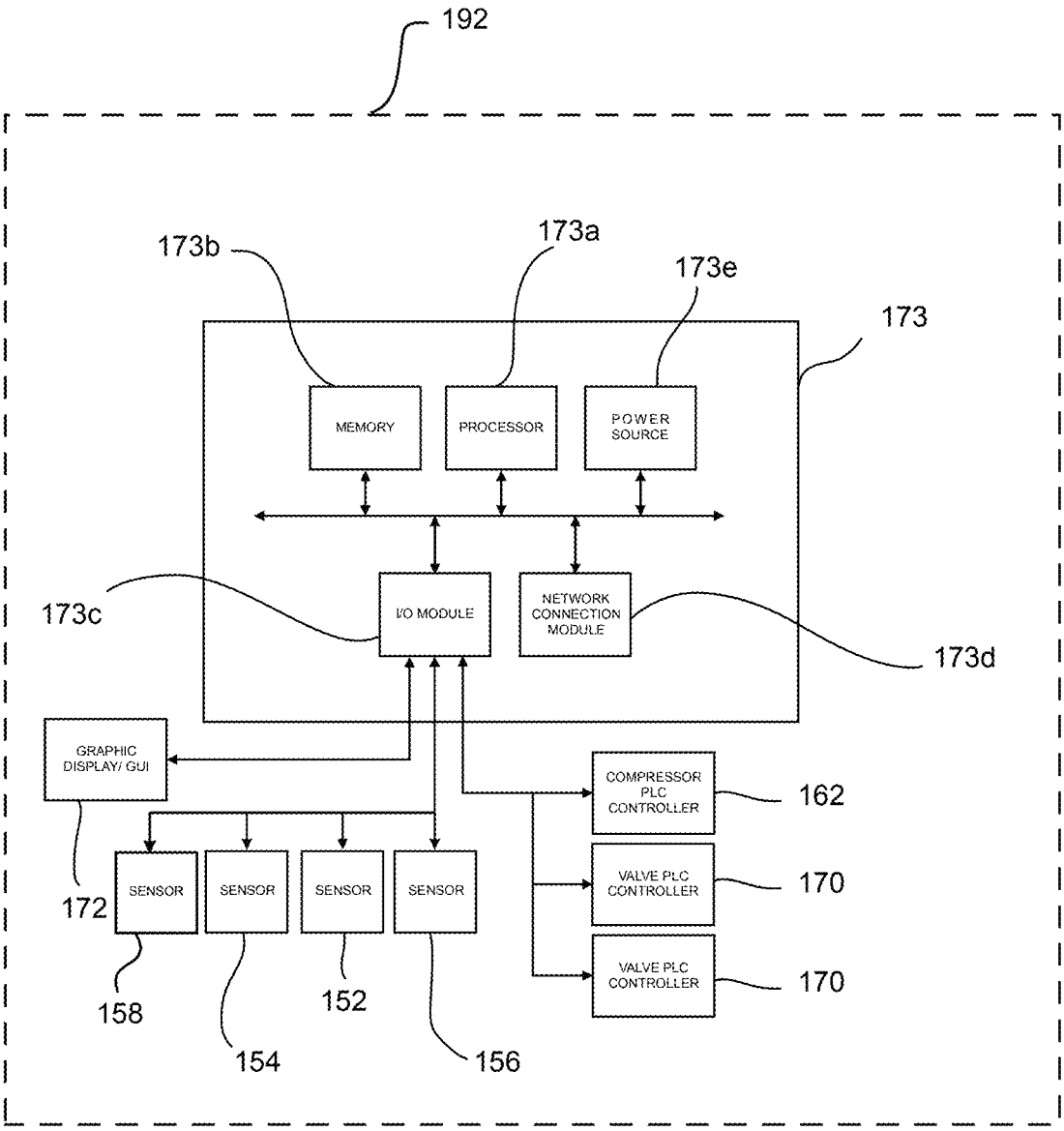
FIG. 9 illustrates a block diagram of the on-board server/controller and additional display unit.

FIG. 9 illustrates a block diagram of the on-board server/controller 173 as shown and described in FIG. 8, and additionally a display unit 172.

Figure 10:
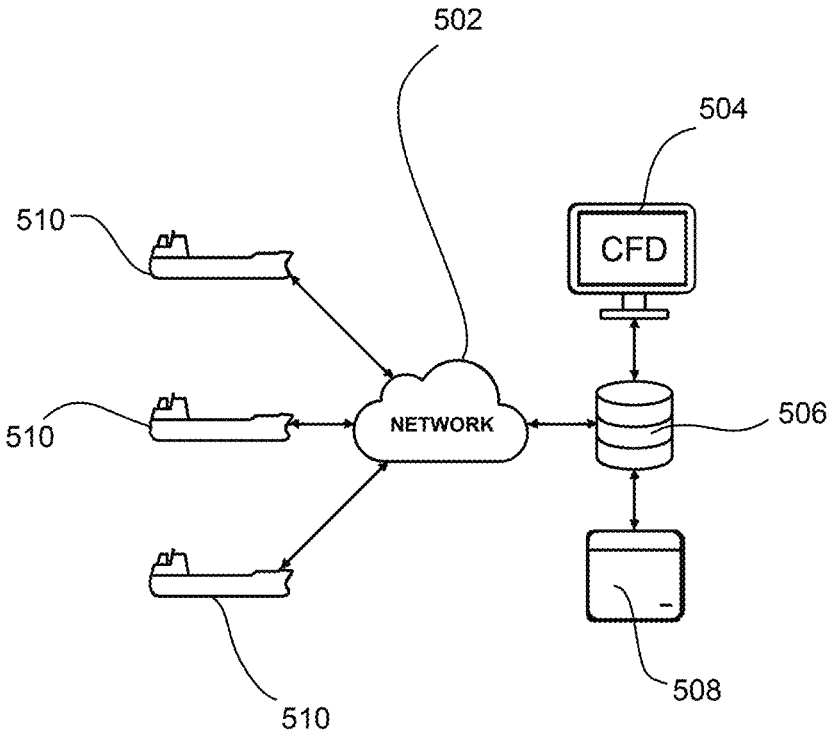
FIG. 10 illustrates a high-level system network diagram including multiple vessels connecting to a server and client devices through a network.

FIG. 10 illustrates a high-level system network diagram including multiple vessels 510, each with a controller as seen in FIGS. 2, 8, and/or 9, connecting to a server 506 and client devices 504/508 through a network 502. The ships may send data over the network 502 to the server that can compile the data and remains accessible for client interfaces 508, and system maintenance and updating, including computers running CFD calculations 504. The server 506 is capable of 2-way communication to collect data from the plurality of vessels 510, while also sending vessels updated information, including new CFD efficiency profiles, weather, and other sea state data.

Figure 11:
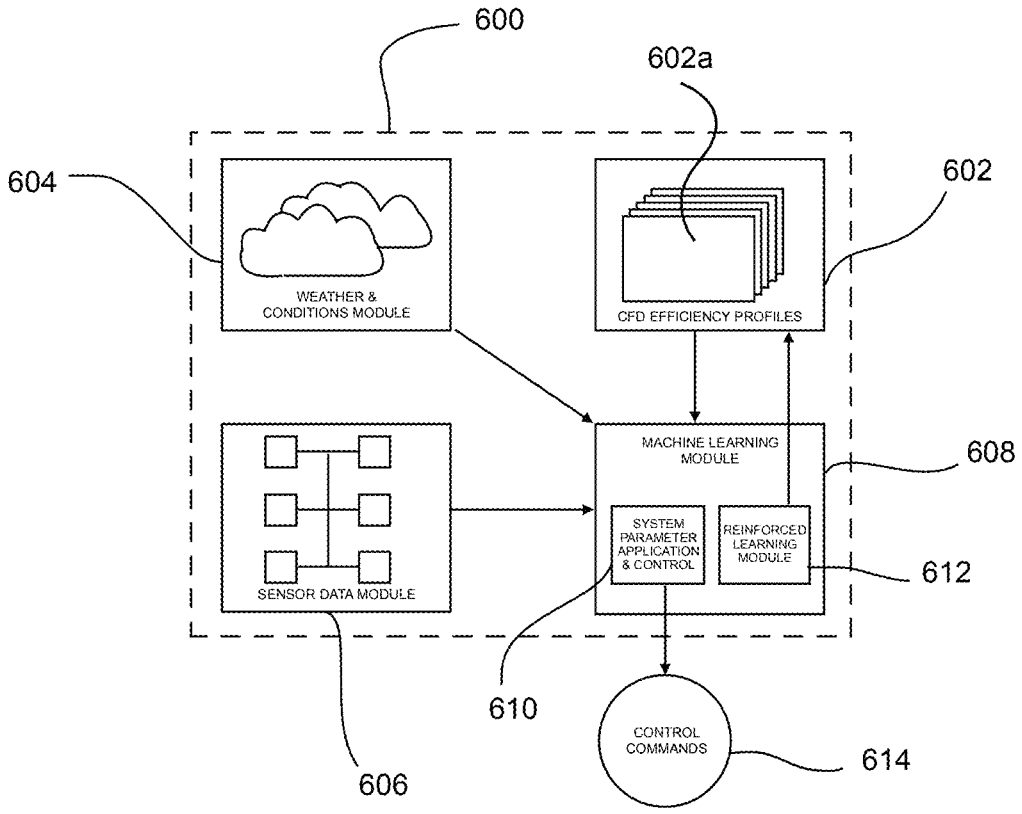
FIG. 11 illustrates a block diagram of the system logic for condition-based airflow delivery.

FIG. 11 illustrates a block diagram of the system logic 600 for condition-based airflow delivery. The system logic includes at least three inputs in the machine learning module 608. These inputs can come from the weather and sea state conditions module 604, which is responsible for importing data obtained outside the ship, from the CFD efficiency profiles 602*a* which are loaded into the logic during installation of the system, though they may be updated, replaced, or supplemented, and the sensor data module 606, bringing together real-time data from the current conditions around the ship. The machine learning module 608 receives the information from these sources and uses it in its methodology to predict near-future conditions, and real-time sea state conditions. Outputs can be to the control commands 614 (reflected in the system flow diagrams in FIGS. 14 and 15) via the system parameter application and control module 610 which applies the system parameters interpolated in the machine learning module. The machine learning module also outputs data to the CFD efficiency profiles module 602 to continuously update the profiles and provide more accurate and better data and more efficient profiles to apply, and does this through the reinforced learning module 612 in the machine learning module 608.

Figure 12:
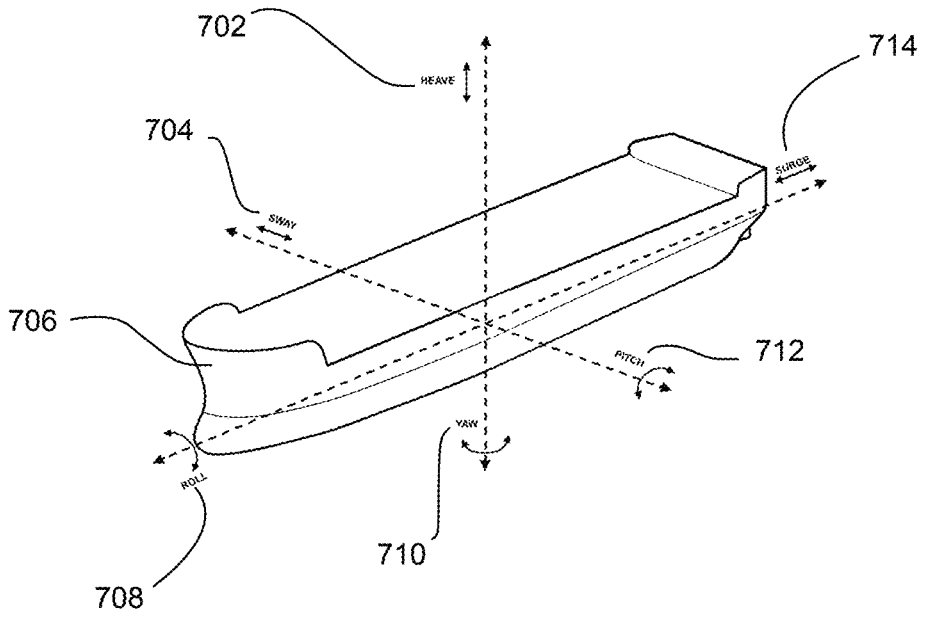
FIG. 12 illustrates an isometric view of a hull of a vessel, conceptually showing heave, sway, roll, yaw, pitch, and surge.

FIG. 12 illustrates an isometric view of a hull of a vessel, conceptually showing heave 702, sway 704, roll 708, yaw 710, pitch 712, and surge 714.

FIG. 13 illustrates a chart 800 of the reconstructed roll angle curve θ(t) based on the filtered gyro data. The noisy sine wave 808 is denoted by a thick dark line, the filtered sine wave 810 is denoted by a thin line, and the reconstructed sine wave 812 denoted by a dashed line. The wave is plotted on an X-axis 804 of the angle 806 in degrees, against time 802 in seconds, on the Y-axis 806.

Figure 14:
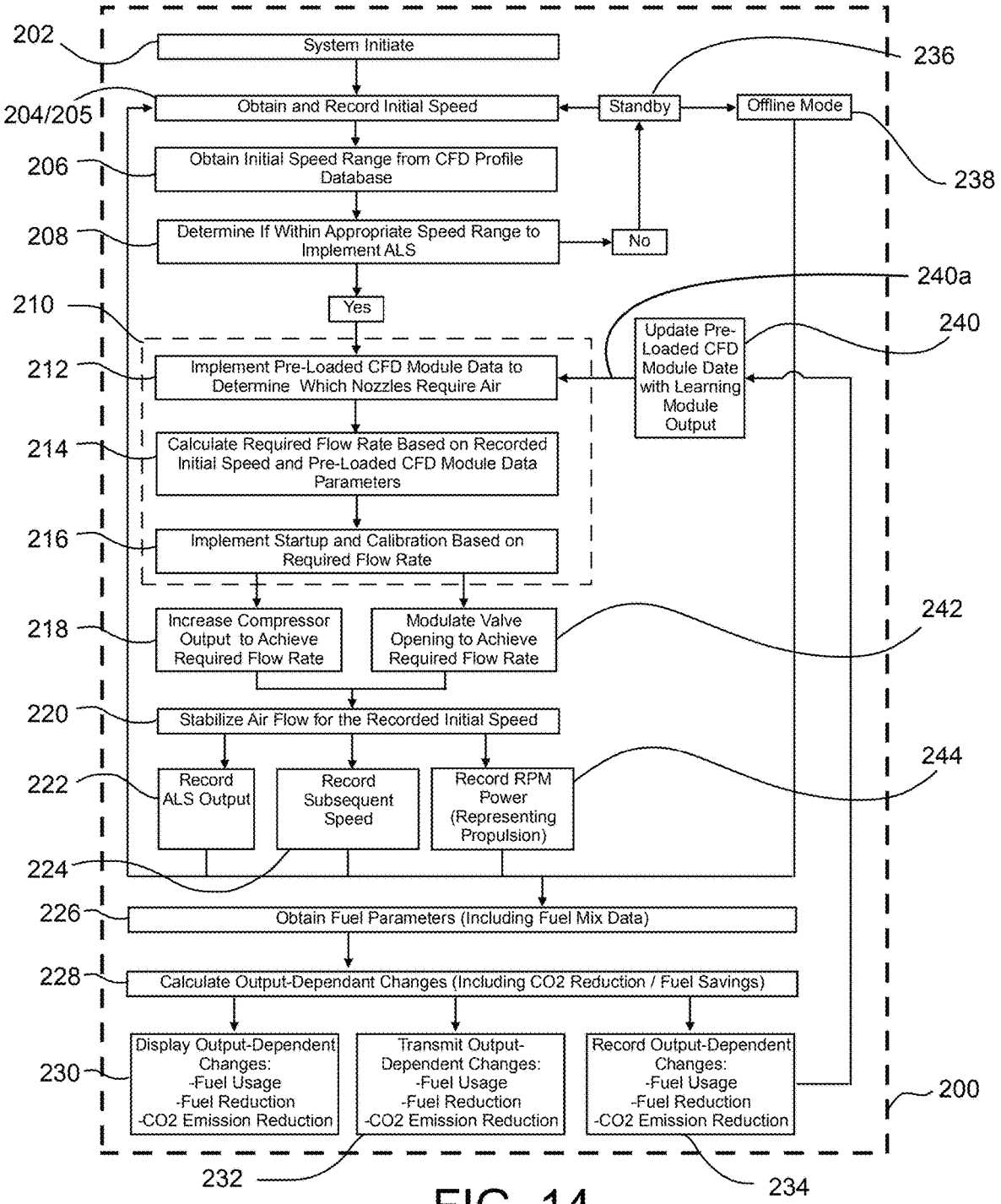
FIG. 14 illustrates a flow diagram of the system operation.

FIG. 14 illustrates a flow diagram of the system 200 operation.

Figure 15:
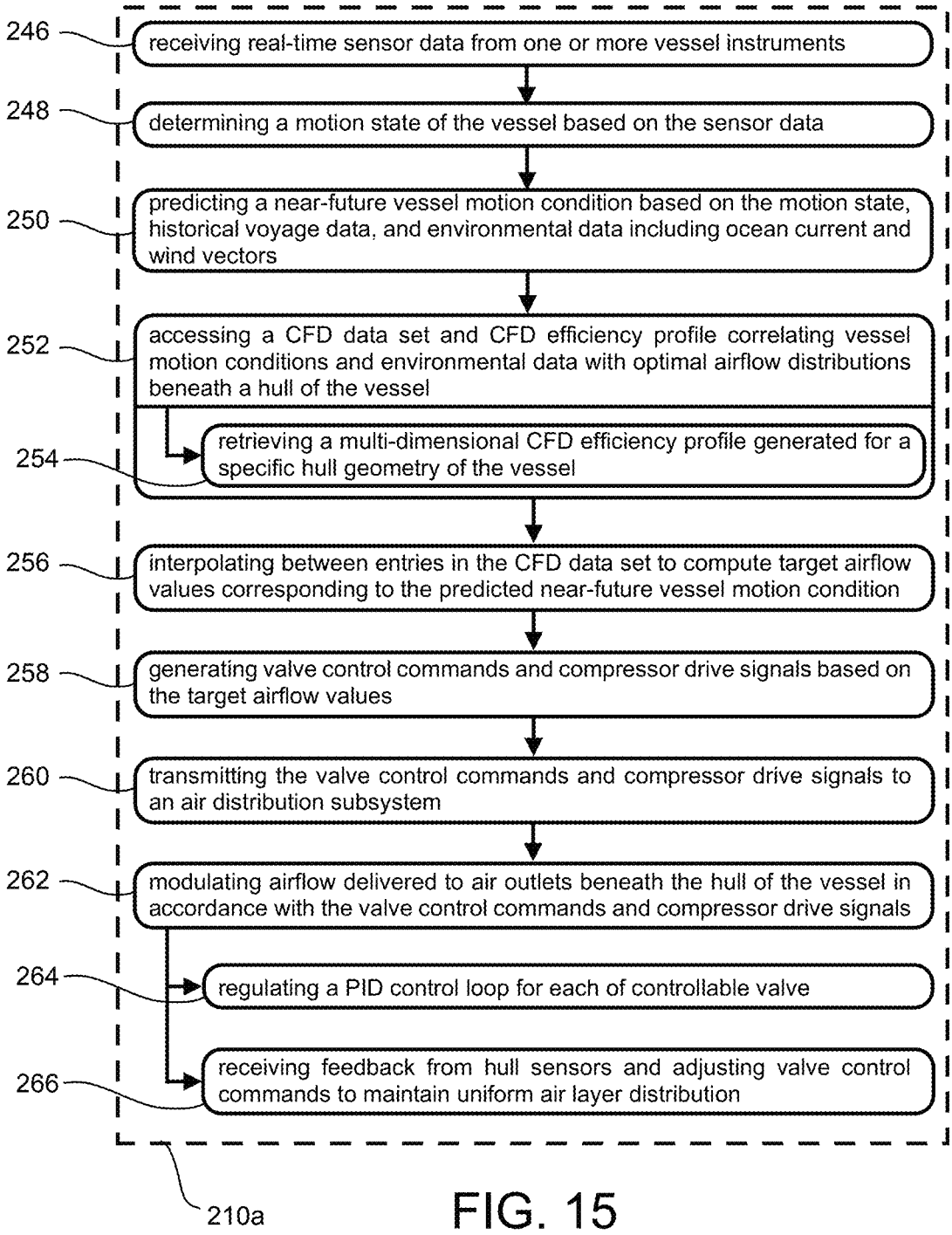
FIG. 15 illustrates a flow diagram of the system logic for predictive modeling and condition-based airflow delivery.

FIG. 15 illustrates a flow diagram of the system logic 210*a* for predictive modeling and condition-based airflow delivery.

In an exemplary embodiment, a computer-implemented method 210*a* for dynamically controlling airflow in an air lubrication system of a vessel is disclosed. The computer-implemented method 210*a* for dynamically controlling airflow in an air lubrication system of a vessel comprises the steps of (i) receiving 246, by a controller 173, real-time sensor data from one or more vessel instruments 154/152/156 including at least a gyroscope 152, an accelerometer 154, and a speed-through-water sensor 156, (ii) determining 248, by the controller 173, a motion state of the vessel 124 based on the sensor data, the motion state comprising roll 708, pitch 712, yaw 710, surge 714, sway 704, and heave 702 parameters, (iii) predicting 250, using a machine learning model 608 executed by the controller 173, a near-future vessel motion condition based on the motion state, historical voyage data, and environmental data including ocean current and wind vectors, (iv) accessing 252, by the controller 173, a computational fluid dynamics (CFD) data set and CFD efficiency profile 602*a* correlating vessel motion conditions and environmental data from the sensor data module 606 and weather and conditions module 604 with optimal airflow distributions beneath a hull of the vessel, (v) interpolating 256, by the controller 173, between entries in the CFD data set to compute one or more target airflow values corresponding to the predicted near-future vessel motion condition, (vi) generating 258, by the controller 173, valve 164 control commands and compressor 160 drive signals based on the target airflow values, (vii) transmitting 260 the valve 164 control commands and compressor 160 drive signals to an air distribution subsystem comprising one or more controllable valves 164 and at least one compressor 160, and (viii) modulating 262, by the air distribution subsystem, airflow delivered to a plurality of nozzles 126 (also called "air outlets") positioned beneath the hull 120 of the vessel 124 in accordance with the valve control commands and compressor drive signals, thereby maintaining an efficient and substantially uniform air layer under varying sea-state conditions In some embodiments, the learning-based prediction engine 612 is configured to predict a subsequent CFD efficiency profile 602*a* based on a temporal sequence of previously applied profiles 602*a*, and to initiate adjustment of air injection parameters prior to occurrence of the predicted hydrodynamic condition.

In some embodiments, the machine learning model 210*a* comprises a reinforcement learning model 612 configured to forecast the near-future vessel motion condition based on continuous real-time sensor data 606 and historical voyage data, the model being iteratively updated to improve prediction accuracy over time.

In some embodiments, accessing 252 the computational fluid dynamics (CFD) data set 602 comprises retrieving a multi-dimensional CFD efficiency profile 602*a* generated for a specific hull geometry 706 of the vessel 124, the CFD efficiency profile 602*a* correlating motion parameters including roll 708, pitch 712, and yaw 710 with corresponding optimal airflow distributions, and wherein interpolating between entries in the CFD efficiency profile 602*a* produces smoothed target airflow values for intermediate motion conditions.

In some embodiments, the computer-implemented method 210*a* for dynamically controlling airflow in an air lubrication system of a vessel 124 further comprises the step of regulating 264, by the controller 173, a proportional-integral-derivative (PID) 170 control loop for each of the plurality of controllable valves 164, the PID 170 control loop employing separate gain coefficients for increasing and decreasing airflow states to stabilize pressure fluctuations in varying sea-state conditions.

In some embodiments, the computer-implemented method 210*a* for dynamically controlling airflow in an air lubrication system of a vessel includes the step of receiving 266 feedback from one or more hull sensors 158 indicative of air layer (such as a sonar, or a capacitance sensor) thickness or coverage beneath the hull 120, and adjusting the valve control commands 614 based on the feedback to maintain a substantially uniform air layer distribution across port and starboard regions of the vessel.

In some embodiments, the computational fluid dynamics (CFD) data set 602 is generated based on a specific hull geometry 706 and nozzle 126 arrangement of the vessel 124, such that the airflow distribution is tailored to the hydrodynamic characteristics of the vessel 124.

In another exemplary embodiment, a system 190 for dynamically controlling airflow in an air lubrication system 168 of a vessel 124 is disclosed. The system 190 for dynamically controlling airflow in an air lubrication system 168 of a vessel 124 includes at least one compressor 160, a plurality of controllable valves 164, a sensor network comprising one or more sensors 152/154/156/174/176/178/180, a control unit 173 comprising a processor 173*a* and a memory 173*b*. The at least one compressor 160 is configured to deliver pressurized air to an air distribution network 168. The plurality of controllable valves 164 is fluidly coupled to the at least one compressor 160 and configured to regulate airflow to a plurality of air outlets 126 positioned beneath a hull 120 of the vessel 124. The sensor network comprising one or more sensors includes gyroscopes 152, accelerometers 154, and speed-through-water sensors 156, configured to provide real-time vessel motion and speed data. The memory 173*b* is used for storing executable instructions and a computational fluid dynamics (CFD) data set 602 correlating vessel motion and environmental parameters with optimal airflow distributions.

The processor 173*a* is configured to execute the executable instructions to (i) determine 248 a motion state of the vessel 124 based on the real-time vessel motion and speed data, (ii) predict 250, using a machine learning model 608, a near-future vessel motion condition based on the motion state, historical voyage data, and environmental conditions, (iii) interpolate 256 one or more target airflow values from the CFD data set 602 corresponding to the predicted near-future vessel motion condition, (iv) generate 258 valve control commands 614 and compressor drive signals based on the interpolated target airflow values, and (v) transmit 260 the valve control commands 614 and compressor drive signals to the plurality of controllable valves 164 and the at least one compressor 160 to modulate airflow delivered to the plurality of air outlets 126. The control unit 173 adjusts the airflow to maintain a substantially uniform air layer beneath the hull 120 under varying sea-state conditions.

In some embodiments, the machine learning model 608 comprises a reinforcement learning model 612 configured to forecast near-future vessel motion conditions based on continuous sensor input 606, historical voyage data, and environmental parameters, the reinforcement learning model 612 being trained to improve prediction accuracy over time.

In some embodiments, the computational fluid dynamics (CFD) data set 602 comprises a multi-dimensional CFD efficiency profile 602*a* generated for a specific hull geometry 706 of the vessel, the CFD efficiency profile 602*a* correlating vessel motion parameters including roll 708, pitch 712, and yaw 710 with corresponding optimal airflow distributions. The control unit 173 is configured to interpolate between entries in the CFD efficiency profile 602/602*a* to compute smoothed target airflow values for intermediate motion states.

In some embodiments, the system further includes a proportional-integral-derivative (PID) 170 control subsystem operatively coupled to each of the plurality of controllable valves 170. The PID control 170 subsystem is configured with separate gain coefficients for airflow-increase and airflow-decrease states to stabilize compressor 160 pressure and airflow under varying sea-state conditions.

In some embodiments, the system 190 further includes one or more hull sensors 158 configured to detect air-layer thickness or coverage beneath the hull 120, wherein the control unit 173 is further configured to modify the valve 164 control commands in response to feedback from the one or more hull sensors 158 to maintain a substantially uniform air distribution across port and starboard regions of the vessel.

In some embodiments, the computational fluid dynamics (CFD) data set 602 stored in the memory 173*b* of the control unit 173 is derived from simulation of the vessel's hull geometry (shown conceptually as hull geometry 706) and nozzle 126 arrangement (shown conceptually in FIG. 3), and is configured to generate airflow profiles matched to the vessel's hydrodynamic characteristics.

In some embodiments, the air outlet 126 comprises an open cavity 132 referred to herein as a sea chest 132 with an air inlet 138 and an open lower boundary 127. The open lower boundary 127 may be configured for a closable flap 128 by affixing the closable flap 128 to a forward engagement area 123 of a mounting flange 125, (shown in more detail in U.S. Ser. No. 18/219,375). It is important to model the presence of such a flap 128 in the CFD calculations, taking into consideration the decrease in drag once the flap 128 is closed.

In yet another exemplary embodiment, an electronic device 192 for air lubrication system control is disclosed. The electronic device 192 comprises at least one processor 173*a* and a memory 173*b* with instructions stored thereon. The instructions, once executed, perform the steps of (i) receiving 246, by a controller 173, real-time sensor data from one or more vessel instruments 154/152/156 including at least a gyroscope 152, an accelerometer 154, and a speed-through-water sensor 156, (ii) determining 248, by the controller 173, a motion state of the vessel 124 based on the sensor data, the motion state comprising roll 708, pitch 712, yaw 710, surge 714, sway 704, and heave 702 parameters, (iii) predicting 250, using a machine learning model 608 executed by the controller 173, a near-future vessel motion condition based on the motion state, historical voyage data, and environmental data including ocean current and wind vectors, (iv) accessing 252, by the controller 173, a computational fluid dynamics (CFD) data set 602 and CFD efficiency profile 602*a* correlating vessel motion conditions and environmental data from the sensor data module 606 and weather and conditions module 604 with optimal airflow distributions beneath a hull of the vessel, (v) interpolating 256, by the controller 173, between entries in the CFD data set to compute one or more target airflow values corresponding to the predicted near-future vessel motion condition, (vi) generating 258, by the controller 173, valve 164 control commands and compressor 160 drive signals based on the target airflow values, (vii) transmitting 260 the valve 164 control commands and compressor 160 drive signals to an air distribution subsystem comprising one or more controllable valves 164 and at least one compressor 160, and (viii) modulating 262, by the air distribution subsystem, airflow delivered to a plurality of nozzles 126 (also called "air outlets") positioned beneath the hull 120 of the vessel 124 in accordance with the valve control commands and compressor drive signals, thereby maintaining an efficient and substantially uniform air layer under varying sea-state conditions.

In some embodiments, the learning-based prediction engine 612 is configured to predict a subsequent CFD efficiency profile 602*a* based on a temporal sequence of previously applied profiles 602*a*, and to initiate adjustment of air injection parameters prior to occurrence of the predicted hydrodynamic condition.

In some embodiments, the machine learning model 608 comprises a reinforcement learning model 612 configured to forecast the near-future vessel motion condition based on continuous real-time sensor data 606 and historical voyage data, the model being iteratively updated to improve prediction accuracy over time.

In some embodiments of the electronic device 192 for air lubrication system control, the step in the instructions, stored on the memory 173*b*, of accessing 252 the computational fluid dynamics (CFD) data set 602 comprises retrieving 254 a multi-dimensional CFD efficiency profile 602*a* generated for a specific hull geometry 706 of the vessel 124, the CFD efficiency profile 602*a* correlating motion parameters including roll 708, pitch 712, and yaw 710 with corresponding optimal airflow distributions, and wherein interpolating between entries in the CFD efficiency profile 602*a* produces smoothed target airflow values for intermediate motion conditions.

In some embodiments of the electronic device 192 for air lubrication system control, the method steps stored in the instructions on the memory further comprise regulating 264, by the controller 173, a proportional-integral-derivative (PID) 170 control loop for each of the plurality of controllable valves 164, the PID 170 control loop employing separate gain coefficients for increasing and decreasing airflow states to stabilize pressure fluctuations in varying sea-state conditions.

In some embodiments of the electronic device 192 for air lubrication system control, the method steps stored in the instructions on the memory further comprise receiving 266 feedback from one or more hull sensors indicative of air layer thickness or coverage beneath the hull, and adjusting the valve control commands 612 based on the feedback to maintain a substantially uniform air layer distribution across port and starboard regions of the vessel 124.

In some embodiments the computational fluid dynamics (CFD) data set is generated based on a specific hull geometry 706 and nozzle arrangement (conceptually shown with nozzles 126 in FIG. 3) of the vessel 124, such that the airflow distribution is tailored to the hydrodynamic characteristics of the vessel 124.

In some embodiments, the electronic device 192 for air lubrication system control further includes an input/output module 173*c* operatively coupled to the controller 173. The input/output module 173 is configured to interface with one or more sensors 152/154/156 and actuators (via valve PLC controller 170) to receive sensor inputs and transmit valve control commands 614 and compressor drive signals within the air lubrication system.

In some embodiments of the electronic device 192 for air lubrication system control, a plurality of sensors 178/152/154/156 are operatively coupled to the input/output module 173*c*. The sensors 178/152/154/156 are configured to provide real-time vessel-state and environmental data to the controller 173 for determining motion conditions and airflow requirements.

In some embodiments, the sensors comprise a gyroscope 152 configured to detect angular motion of the vessel 124 about roll 708, pitch 712, and yaw 710 axes, an accelerometer 154 configured to measure linear acceleration of the vessel 124 along surge 714, sway 704, and heave 702 axes, a speed-through-water sensor 156 configured to determine vessel 124 velocity relative to the surrounding water, and a global positioning system (GPS) 178 receiver configured to provide vessel 124 position and velocity data used for determining motion state and voyage history.

In another exemplary embodiment, a computer-implemented method 200 for dynamically controlling airflow in an air lubrication system of a vessel is provided. FIG. 14 illustrates a flow diagram of the system 200 operation. The after the system initiates 202, the method 200 comprises the steps of (i) obtaining 204 an initial speed of a marine vessel, (ii) recording 205 said speed of said marine vessel in a memory 173*b*, (iii) obtaining 206 an initial speed range from a table of speed ranges stored in a CFD efficiency profile 602 database (iv) determining 208 if said recorded speed recorded in said memory 173*b* is within a range of speeds appropriate for implementing air lubrication, (v) implementing 212 a pre-loaded CFD efficiency profile module data to determine which air injector ports 126 require air, if said recorded speed recorded in said memory 173*b* is within a range of speeds appropriate for implementing air lubrication (vi) calculating 214 a required flow rate of air based on the recorded initial speed and parameters from the pre-loaded CFD efficiency profile module data (vii) implementing 216 a startup and calibration sequence based on the required flow rate (viii) increasing 218 compressor 160 output to achieve the required flow rate and modulating 242 at least one valve 164 opening to achieve said required flow rate, and (ix) stabilizing 220 air flow for the recorded initial speed by modulating the compressor 160 output and the at least one valve 164 opening.

In some embodiments when the recorded speed recorded in the memory is not within a range of speeds appropriate for implementing air lubrication, the system initiates standby mode 236. When standby mode is initiated, the system loops back through (i) obtaining 204 an initial speed of a marine vessel if standby mode is initiated, (ii) recording 205 said speed of said marine vessel in a memory 173*b*, (iii) obtaining 206 an initial speed range from a table of speed ranges stored in a CFD efficiency profile database, (iv) determining 208 if said recorded speed recorded in said memory is within a range of speeds appropriate for implementing air lubrication. This loop continues until the speed is within an appropriate speed range to implement ALS.

In some embodiments, the system initiates offline mode 238 if standby mode 236 is initiated. When offline mode 238 is initiated, the method further comprises the steps of (i) obtaining 226 fuel parameters including fuel mix data from stored data on said memory, and (ii) calculating 228 output-dependent changes including carbon dioxide reduction and fuel savings.

In some embodiments, the computer-implemented method 200 for dynamically controlling airflow in an air lubrication system of a vessel further comprising the steps of displaying 230, on a GUI 172, fuel usage, fuel reduction, and carbon dioxide emission reduction.

In some embodiments, the computer-implemented method 200 for dynamically controlling airflow in an air lubrication system of a vessel further comprising the steps of transmitting 232, via a communication module 173*d*, fuel usage, fuel reduction, and carbon dioxide emission reduction to a central database.

In some embodiments, the computer-implemented method 200 for dynamically controlling airflow in an air lubrication system of a vessel further comprising the steps of recording 234 fuel usage, fuel reduction, and carbon dioxide emission reduction, interpolating recorded variables in the learning module 608, and updating 240 pre-loaded CFD efficiency profile module 602 data.

In some embodiments, the step of implementing 212 a pre-loaded CFD efficiency profile module data to determine which air injector ports require air further comprises receiving 240*a* updated pre-loaded CFD efficiency profile module data from said learning module output 240.

In some embodiments, the steps of (i) implementing 212 a pre-loaded CFD efficiency profile module data to determine which air injector ports require air, (ii) calculating 214 a required flow rate of air based on the recorded initial speed and parameters from the pre-loaded CFD efficiency profile module data and (iii) implementing 216 a startup and calibration sequence based on the required flow rate form a system initiation sequence 210. The system initiation sequence 210 may further expands into the steps of (i) receiving 246, by a controller 173, real-time sensor data from one or more vessel instruments including at least a gyroscope 152, an accelerometer 154, and a speed-through-water sensor 156, (ii) determining 248, by the controller 173, a motion state of the vessel based on the sensor data, the motion state comprising roll 708, pitch 712, yaw 710, surge 714, sway 704, and heave 702 parameters, (iii) predicting 250, using a machine learning model 608 executed by the controller 173, a near-future vessel motion condition based on the motion state, historical voyage data, and environmental data including ocean current and wind vectors, (iv) accessing 252, by the controller 173, a computational fluid dynamics (CFD) data set 602 and CFD efficiency profile 602*a* correlating vessel motion conditions and environmental data from the sensor data module 606 and weather and conditions module 604 with optimal airflow distributions beneath a hull of the vessel, (v) interpolating 256, by the controller 173, between entries in the CFD data set to compute one or more target airflow values corresponding to the predicted near-future vessel motion condition, (vi) generating 258, by the controller 173, valve 164 control commands and compressor 160 drive signals based on the target airflow values, (vii) transmitting 260 the valve 164 control commands and compressor 160 drive signals to an air distribution subsystem comprising one or more controllable valves 164 and at least one compressor 160, and (viii) modulating 262, by the air distribution subsystem, airflow delivered to a plurality of nozzles 126 (also called "air outlets") positioned beneath the hull 120 of the vessel 124 in accordance with the valve control commands and compressor drive signals, thereby maintaining an efficient and substantially uniform air layer under varying sea-state conditions.

While there has been shown and described above the preferred embodiment of the instant invention it is to be appreciated that the invention may be embodied otherwise than is herein specifically shown and described and that certain changes may be made in the form and arrangement of the parts without departing from the underlying ideas or principles of this invention as set forth in the Claims appended herewith.

We claim:

1. A computer-implemented method for dynamically controlling airflow in an air lubrication system of a vessel, the method comprising:

receiving, by a controller, real-time sensor data from one or more vessel instruments including at least a gyroscope, an accelerometer, and a speed-through-water sensor;

determining, by the controller, a motion state of the vessel based on the sensor data, the motion state comprising roll, pitch, yaw, surge, sway, and heave parameters;

predicting, using a machine learning model executed by the controller, a near-future vessel motion condition based on the motion state, historical voyage data, and environmental data including ocean current and wind vectors;

accessing, by the controller, a computational fluid dynamics (CFD) data set and CFD efficiency profile correlating vessel motion conditions and environmental data with optimal airflow distributions beneath a hull of the vessel;

interpolating, by the controller, between entries in the CFD data set to compute one or more target airflow values corresponding to the predicted near-future vessel motion condition;

generating, by the controller, valve control commands and compressor drive signals based on the target airflow values;

transmitting the valve control commands and compressor drive signals to an air distribution subsystem comprising one or more controllable valves and at least one compressor; and modulating, by the air distribution subsystem, airflow delivered to a plurality of nozzles or air outlets positioned beneath the hull of the vessel in accordance with the valve control commands and compressor drive signals, thereby maintaining an efficient and substantially uniform air layer under varying sea-state conditions.

2. The computer-implemented method for dynamically controlling airflow in an air lubrication system of a vessel, as recited in claim 1, wherein the learning-based prediction engine is configured to predict a subsequent CFD efficiency profile based on a temporal sequence of previously applied profiles, and to initiate adjustment of air injection parameters prior to occurrence of the predicted hydrodynamic condition.

3. The computer-implemented method for dynamically controlling airflow in an air lubrication system of a vessel, as recited in claim 1, wherein the machine learning model comprises a reinforcement learning model configured to forecast the near-future vessel motion condition based on continuous real-time sensor data and historical voyage data, the model being iteratively updated to improve prediction accuracy over time.

4. The computer-implemented method for dynamically controlling airflow in an air lubrication system of a vessel, as recited in claim 1, wherein accessing the computational fluid dynamics (CFD) data set comprises retrieving a multi-dimensional CFD efficiency profile generated for a specific hull geometry of the vessel, the CFD efficiency profile correlating motion parameters including roll, pitch, and yaw with corresponding optimal airflow distributions, and wherein interpolating between entries in the CFD efficiency profile produces smoothed target airflow values for intermediate motion conditions.

5. The computer-implemented method for dynamically controlling airflow in an air lubrication system of a vessel, as recited in claim 1, further comprising:

regulating, by the controller, a proportional-integral-derivative (PID) control loop for each of the plurality of controllable valves, the PID control loop employing separate gain coefficients for increasing and decreasing airflow states to stabilize pressure fluctuations in varying sea-state conditions.

6. The computer-implemented method for dynamically controlling airflow in an air lubrication system of a vessel, as recited in claim 1, further comprising:

receiving feedback from one or more hull sensors indicative of air layer thickness or coverage beneath the hull, and adjusting the valve control commands based on the feedback to maintain a substantially uniform air layer distribution across port and starboard regions of the vessel.

7. The computer-implemented method for dynamically controlling airflow in an air lubrication system of a vessel, as recited in claim 1, wherein the computational fluid dynamics (CFD) data set is generated based on a specific hull geometry and nozzle arrangement of the vessel, such that the airflow distribution is tailored to the hydrodynamic characteristics of the vessel.

8. A system for dynamically controlling airflow in an air lubrication system of a vessel, comprising:

at least one compressor configured to deliver pressurized air to an air distribution network;

a plurality of controllable valves fluidly coupled to the at least one compressor and configured to regulate airflow to a plurality of air outlets positioned beneath a hull of the vessel;

a sensor network comprising one or more sensors selected from the group consisting of gyroscopes, accelerometers, and speed-through-water sensors, configured to provide real-time vessel motion and speed data;

a control unit comprising a processor and a memory, the memory storing executable instructions and a computational fluid dynamics (CFD) data set correlating vessel motion and environmental parameters with optimal airflow distributions; and wherein the processor is configured to execute the executable instructions to:

determine a motion state of the vessel based on the real-time vessel motion and speed data;

predict, using a machine learning model, a near-future vessel motion condition based on the motion state, historical voyage data, and environmental conditions;

interpolate one or more target airflow values from the CFD data set corresponding to the predicted near-future vessel motion condition;

generate valve control commands and compressor drive signals based on the interpolated target airflow values; and transmit the valve control commands and compressor drive signals to the plurality of controllable valves and the at least one compressor to modulate airflow delivered to the plurality of air outlets, wherein the control unit adjusts the airflow to maintain a substantially uniform air layer beneath the hull under varying sea-state conditions.

9. The system for dynamically controlling airflow in an air lubrication system of a vessel, as recited in claim 8, wherein the machine learning model comprises a reinforcement learning model configured to forecast near-future vessel motion conditions based on continuous sensor input, historical voyage data, and environmental parameters, the reinforcement learning model being trained to improve prediction accuracy over time.

10. The system for dynamically controlling airflow in an air lubrication system of a vessel, as recited in claim 8, wherein the computational fluid dynamics (CFD) data set comprises a multi-dimensional CFD efficiency profile generated for a specific hull geometry of the vessel, the CFD efficiency profile correlating vessel motion parameters including roll, pitch, and yaw with corresponding optimal airflow distributions, and wherein the control unit is configured to interpolate between entries in the CFD efficiency profile to compute smoothed target airflow values for intermediate motion states.

11. The system for dynamically controlling airflow in an air lubrication system of a vessel, as recited in claim 10, further comprising:

a proportional-integral-derivative (PID) control subsystem operatively coupled to each of the plurality of controllable valves, the PID control subsystem being configured with separate gain coefficients for airflow-increase and airflow-decrease states to stabilize compressor pressure and airflow under varying sea-state conditions.

12. The system for dynamically controlling airflow in an air lubrication system of a vessel, as recited in claim 10, further comprising:

one or more hull sensors configured to detect air-layer thickness or coverage beneath the hull, wherein the control unit is further configured to modify the valve control commands in response to feedback from the one or more hull sensors to maintain a substantially uniform air distribution across port and starboard regions of the vessel.

13. The system for dynamically controlling airflow in an air lubrication system of a vessel, as recited in claim 10, wherein the computational fluid dynamics (CFD) data set stored in the memory of the control unit is derived from simulation of the vessel's hull geometry and nozzle arrangement, and is configured to generate airflow profiles matched to the vessel's hydrodynamic characteristics.

14. The system for dynamically controlling airflow in an air lubrication system of a vessel, as recited in claim 9, wherein each air outlet in said plurality of air outlets comprises a sea chest with an air inlet and an open lower boundary.

15. An electronic device for air lubrication system control, comprising:

at least one processor; and a memory with instructions stored thereon, wherein said instructions, once executed perform the steps of:

receiving, by a controller, real-time sensor data from one or more vessel instruments including at least a gyroscope, an accelerometer, and a speed-through-water sensor;

determining, by the controller, a motion state of the vessel based on the sensor data, the motion state comprising roll, pitch, yaw, surge, sway, and heave parameters;

predicting, using a machine learning model executed by the controller, a near-future vessel motion condition based on the motion state, historical voyage data, and environmental data including ocean current and wind vectors;

accessing, by the controller, a computational fluid dynamics (CFD) data set and CFD efficiency profile correlating vessel motion conditions and environmental data with optimal airflow distributions beneath a hull of the vessel;

interpolating, by the controller, between entries in the CFD data set to compute one or more target airflow values corresponding to the predicted near-future vessel motion condition;

generating, by the controller, valve control commands and compressor drive signals based on the target airflow values;

transmitting the valve control commands and compressor drive signals to an air distribution subsystem comprising one or more controllable valves and at least one compressor; and modulating, by the air distribution subsystem, airflow delivered to a plurality of nozzles or air outlets positioned beneath the hull of the vessel in accordance with the valve control commands and compressor drive signals, thereby maintaining an efficient and substantially uniform air layer under varying sea-state conditions.

16. The electronic device for air lubrication system control, as recited in claim 15, wherein the learning-based prediction engine is configured to predict a subsequent CFD efficiency profile based on a temporal sequence of previously applied profiles, and to initiate adjustment of air injection parameters prior to occurrence of the predicted hydrodynamic condition.

17. The electronic device for air lubrication system control, as recited in claim 15, wherein the machine learning model comprises a reinforcement learning model configured to forecast the near-future vessel motion condition based on continuous real-time sensor data and historical voyage data, the model being iteratively updated to improve prediction accuracy over time.

18. The electronic device for air lubrication system control, as recited in claim 15, wherein the step in the instructions, stored on the memory, of accessing the computational fluid dynamics (CFD) data set in the instructions store on the memory comprises retrieving a multi-dimensional CFD efficiency profile generated for a specific hull geometry of the vessel, the CFD efficiency profile correlating motion parameters including roll, pitch, and yaw with corresponding optimal airflow distributions, and wherein interpolating between entries in the CFD efficiency profile produces smoothed target airflow values for intermediate motion conditions.

19. The electronic device for air lubrication system control, as recited in claim 15, wherein the method steps stored in the instructions on the memory further comprise:

regulating, by the controller, a proportional-integral-derivative (PID) control loop for each of the plurality of controllable valves, the PID control loop employing separate gain coefficients for increasing and decreasing airflow states to stabilize pressure fluctuations in varying sea-state conditions.

20. The electronic device for air lubrication system control, as recited in claim 15, wherein the method steps stored in the instructions on the memory further comprise:

receiving feedback from one or more hull sensors indicative of air layer thickness or coverage beneath the hull, and adjusting the valve control commands based on the feedback to maintain a substantially uniform air layer distribution across port and starboard regions of the vessel.

21. The electronic device for air lubrication system control, as recited in claim 15, wherein the computational fluid dynamics (CFD) data set is generated based on a specific hull geometry and nozzle arrangement of the vessel, such that the airflow distribution is tailored to the hydrodynamic characteristics of the vessel.

22. The electronic device for air lubrication system control, as recited in claim 15, further comprising:

an input/output module operatively coupled to the controller, the input/output module configured to interface with one or more sensors and actuators to receive sensor inputs and transmit valve control commands and compressor drive signals within the air lubrication system.

23. The electronic device for air lubrication system control, as recited in claim 22, further comprising:

a plurality of sensors operatively coupled to the input/output module, the plurality of sensors configured to provide real-time vessel-state and environmental data to the controller for determining motion conditions and airflow requirements.

24. The electronic device for air lubrication system control, as recited in claim 23, wherein at least one sensor of the plurality of sensors comprises a gyroscope configured to detect angular motion of the vessel about roll, pitch, and yaw axes.

25. The electronic device for air lubrication system control, as recited in claim 23, wherein at least one sensor of the plurality of sensors comprises an accelerometer configured to measure linear acceleration of the vessel along surge, sway, and heave axes.

26. The electronic device for air lubrication system control, as recited in claim 23, wherein at least one sensor of the plurality of sensors comprises a speed-through-water sensor configured to determine vessel velocity relative to the surrounding water.

27. The electronic device for air lubrication system control, as recited in claim 23, wherein at least one sensor of the plurality of sensors comprises a global positioning system (GPS) receiver configured to provide vessel position and velocity data used for determining motion state and voyage history.

* * * * *